US012447517B2

(12) United States Patent
Sorao

(10) Patent No.: US 12,447,517 B2
(45) Date of Patent: Oct. 21, 2025

(54) ROLLING CONTROL DEVICE, ROLLING CONTROL METHOD, AND PROGRAM

(71) Applicant: NIPPON STEEL CORPORATION, Tokyo (JP)

(72) Inventor: Kenji Sorao, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 263 days.

(21) Appl. No.: 18/034,853

(22) PCT Filed: Oct. 22, 2021

(86) PCT No.: PCT/JP2021/039078
§ 371 (c)(1),
(2) Date: May 1, 2023

(87) PCT Pub. No.: WO2022/097501
PCT Pub. Date: May 12, 2022

(65) Prior Publication Data

US 2023/0398590 A1 Dec. 14, 2023

(30) Foreign Application Priority Data

Nov. 4, 2020 (JP) ..... 2020-184290

(51) Int. Cl.
*B21B 37/56* (2006.01)
*B21B 37/46* (2006.01)
*B21B 37/48* (2006.01)

(52) U.S. Cl.
CPC ..... *B21B 37/56* (2013.01); *B21B 37/46* (2013.01); *B21B 37/48* (2013.01); *B21B 2261/22* (2013.01)

(58) Field of Classification Search
CPC ..... B21B 37/46; B21B 37/48; B21B 37/56; B21B 38/04; B21B 38/08; B21B 2001/228; B21B 2261/22; B21B 2265/12
See application file for complete search history.

(56) References Cited

FOREIGN PATENT DOCUMENTS

CN 105583236 * 5/2016
EP 2933033 A1 * 10/2015
(Continued)

OTHER PUBLICATIONS

Kubo et al., "Computer Control Systems Applied to Steel Plants", Hitachi Review, vol. 58, No. 6, Jun. 1976, total of 6 pages.
(Continued)

*Primary Examiner* — Edward T Tolan
(74) *Attorney, Agent, or Firm* — Birch, Stewart, Kolasch & Birch, LLP

(57) ABSTRACT

A rolling control device (10) updates a preset load value $P_{set}$ based on operation actual results at timings $t_a$ to $t_b$. The rolling control device (10) derives a plasticity coefficient $Q_{chk}$ based on operation actual results at timings $t_b$ to $t_c$. When the determining that it is necessary to re-update the updated preset load value $P_{set}$ based on the plasticity coefficient $Q_{chk}$, the rolling control device (10) updates the preset load value $P_{set}$ again based on the operation actual results at the timings $t_b$ to $t_c$.

9 Claims, 11 Drawing Sheets

(56) References Cited

FOREIGN PATENT DOCUMENTS

| | | | | |
|---|---|---|---|---|
| JP | 55-81011 | A | * | 6/1980 |
| JP | 55-94722 | A | * | 7/1980 |
| JP | 2002-282922 | A | * | 10/2002 |
| KR | 100325334 | B1 | * | 8/2002 |
| KR | 100558787 | B1 | * | 3/2006 |

OTHER PUBLICATIONS

Kubo et al., "Computer Control Systems Applied to Steel Plants," Hitachi Review, vol. 58, No. 6, Jun. 1976, 8 pages total, with a partial English translation.

* cited by examiner

ROLLING CONTROL DEVICE, ROLLING CONTROL METHOD, AND PROGRAM

TECHNICAL FIELD

The present invention relates to a rolling control device, a rolling control method, and a program, and in particular, is ones to be suitable when used for controlling the operation of a temper rolling mill. This application is based upon and claims the benefit of priority of the prior Japanese Patent Application No. 2020-184290, filed on Nov. 4, 2020, the entire contents of which are incorporated herein by reference.

BACKGROUND ART

In a continuous processing line of cold-rolled steel sheets, the tail end of a preceding steel sheet is welded to the leading end of a following steel sheet. A plurality of steel sheets joined by welding are subjected to continuous annealing and continuous temper rolling. At this time, the elongation rate of the steel sheet is controlled based on a rolling load at a temper rolling mill. In such control, immediately before a welded portion of the steel sheet passes through the temper rolling mill, after rolling by the temper rolling mill is brought into a suspended (mill open) state or the temper rolling mill is brought into a soft reduction state, and further after the welded portion of the steel sheet passes through the temper rolling mill, the control based on the previously-described rolling load is resumed. In this case, it is desired that the elongation rate of the steel sheet becomes a target value in a short time after the control of the elongation rate of the steel sheet based on the rolling load is resumed.

Patent Literature 1 has disclosed the following technique. First, when the deviation of an actual result value of an elongation rate of a steel sheet from a target value is large, the correction amount of a rolling load for correcting a preset rolling load is derived. The correction amount of the rolling load is derived based on the plasticity coefficient and the entry-side sheet thickness at the timing before the actual result value of the rolling load of the temper rolling mill becomes the preset rolling load. Then, the temper rolling mill reduces the steel sheet so that the rolling load of the temper rolling mill becomes the rolling load obtained by adding the correction amount to the preset rolling load.

CITATION LIST

Patent Literature

Patent Literature 1: Japanese Laid-open Patent Publication No. 2002-282922

Non-Patent Literature

Non-Patent Literature 1: KUBO Takeaki, KOSAKA Mitsuyoshi "Computer Control Systems Applied to Steel Plants," Hitachi Review, VOL. 58, No. 6, June, 1976

SUMMARY OF INVENTION

Technical Problem

However, in the technique described in Patent Literature 1, the plasticity coefficient of the steel sheet at the timing before the actual result value of the rolling load of the temper rolling mill becomes the preset rolling load is estimated. Thus, when there is a discrepancy between the estimated plasticity coefficient of the steel sheet and the plasticity coefficient of the steel sheet at the timing when the temper rolling mill reduces the steel sheet so as to achieve the corrected rolling load, the desired elongation rate is not achieved even if the temper rolling mill reduces the steel sheet so as to achieve the corrected rolling load. Particularly, when the estimated plasticity coefficient of the steel sheet is excessively large compared to the actual plasticity coefficient, if the temper rolling mill reduces the steel sheet so that the rolling load becomes the corrected rolling load, the reduction amount becomes excessively large. As a result, the elongation rate of the steel sheet becomes excessively large relative to the target value. Therefore, there is a possibility that the elongation rate of the steel sheet will not converge to the target value or to the vicinity of the target value in a short period of time. Further, in the case of a steel sheet whose plasticity coefficient varies greatly in accordance with the variations in reduction rate (elongation rate), the discrepancy of the previously-described plasticity coefficient becomes large. Therefore, when the technique described in Patent Literature 1 is applied to such a steel sheet, there is a possibility that the time required to converge the elongation rate of the steel sheet to the target value or to the vicinity of the target value may become longer.

The present invention has been made in consideration of the above problems, and an object thereof is to shorten the time required to converge the elongation rate of a steel sheet to a target value or to the vicinity of the target value.

Solution to Problem

The rolling control device of the present invention is a rolling control device that derives a preset load value in order to bring an elongation rate of a metal sheet to a target value or within a target range after a welded portion of the metal sheet passes through a temper rolling mill while rolling is suspended or under soft reduction, and outputs a reduction command based on the preset load value, the device includes: a first preset load updating means that derives an updated value of the preset load based on operation actual result values during a first period from a first timing to a second timing; an evaluation index deriving means that derives an evaluation index of the difference between a plasticity coefficient of the metal sheet during the first period and a plasticity coefficient of the metal sheet during a second period from the second timing to a third timing; a determining means that determines whether or not the updated value of the preset load derived by the first preset load updating means needs to be updated again based on the evaluation index derived by the evaluation index deriving means; and a second preset load updating means that derives a re-updated value of the preset load based on operation actual result values during the second period when the determining means determines that the updated value of the preset load derived by the first preset load updating means needs to be updated again, in which the preset load is a rolling load to be preset as a target rolling load of the temper rolling mill, the first timing is a timing before a timing when a measured value of a rolling load at the temper rolling mill becomes the preset load, the second timing is a timing when the measured value of the rolling load at the temper rolling mill has become the preset load, and the third timing is a timing before the measured value of the rolling load at the temper rolling mill becomes the updated value of the preset load derived by the first preset load updating means.

The rolling control method of the present invention is a rolling control method that derives a preset load value in order to bring an elongation rate of a metal sheet to a target value or within a target range after a welded portion of the metal sheet passes through a temper rolling mill while rolling is suspended or under soft reduction, and outputs a reduction command based on the preset load value, the method including: a first preset load updating step that derives an updated value of the preset load based on operation actual result values during a first period from a first timing to a second timing; an evaluation index deriving step that derives an evaluation index of the difference between a plasticity coefficient of the metal sheet during the first period and a plasticity coefficient of the metal sheet during a second period from the second timing to a third timing; a determining step that determines whether or not the updated value of the preset load derived by the first preset load updating step needs to be updated again based on the evaluation index derived by the evaluation index deriving step; and a second preset load updating step that derives a re-updated value of the preset load based on operation actual result values during the second period when the determining step determines that the updated value of the preset load derived by the first preset load updating step needs to be updated again, in which the preset load is a rolling load to be preset as a target rolling load of the temper rolling mill, the first timing is a timing before a timing when a measured value of a rolling load at the temper rolling mill becomes the preset load, the second timing is a timing when the measured value of the rolling load at the temper rolling mill has become the preset load, and the third timing is a timing before the measured value of the rolling load at the temper rolling mill becomes the updated value of the preset load derived by the first preset load updating step.

The program of the present invention is a program causing a computer to execute pieces of processing intended for deriving a preset load value in order to bring an elongation rate of a metal sheet to a target value or within a target range after a welded portion of the metal sheet passes through a temper rolling mill while rolling is suspended or under soft reduction, and outputting a reduction command based on the preset load value, the program causing a computer to execute: a first preset load updating step that derives an updated value of the preset load based on operation actual result values during a first period from a first timing to a second timing; an evaluation index deriving step that derives an evaluation index of the difference between a plasticity coefficient of the metal sheet during the first period and a plasticity coefficient of the metal sheet during a second period from the second timing to a third timing; a determining step that determines whether or not the updated value of the preset load derived by the first preset load updating step needs to be updated again based on the evaluation index derived by the evaluation index deriving step; and a second preset load updating step that derives a re-updated value of the preset load based on operation actual result values during the second period when the determining step determines that the updated value of the preset load derived by the first preset load updating step needs to be updated again, in which the preset load is a rolling load to be preset as a target rolling load of the temper rolling mill, the first timing is a timing before a timing when a measured value of a rolling load at the temper rolling mill becomes the preset load, the second timing is a timing when the measured value of the rolling load at the temper rolling mill has become the preset load, and the third timing is a timing before the measured value of the rolling load at the temper rolling mill becomes the updated value of the preset load derived by the first preset load updating step.

DESCRIPTION OF EMBODIMENTS

Hereinafter, there will be explained embodiments of the present invention with reference to the drawings.

Incidentally, the fact that objects to be compared such as lengths, positions, sizes, and intervals, are the same includes the case where they are strictly the same, as well as the case where they are different within a range that does not depart from the gist of the invention (for example, the case where they are different within a tolerance range defined at the time of design).

First Embodiment

First, there is explained a first embodiment.

<Configuration of a Temper Rolling Facility>

Figure 1:
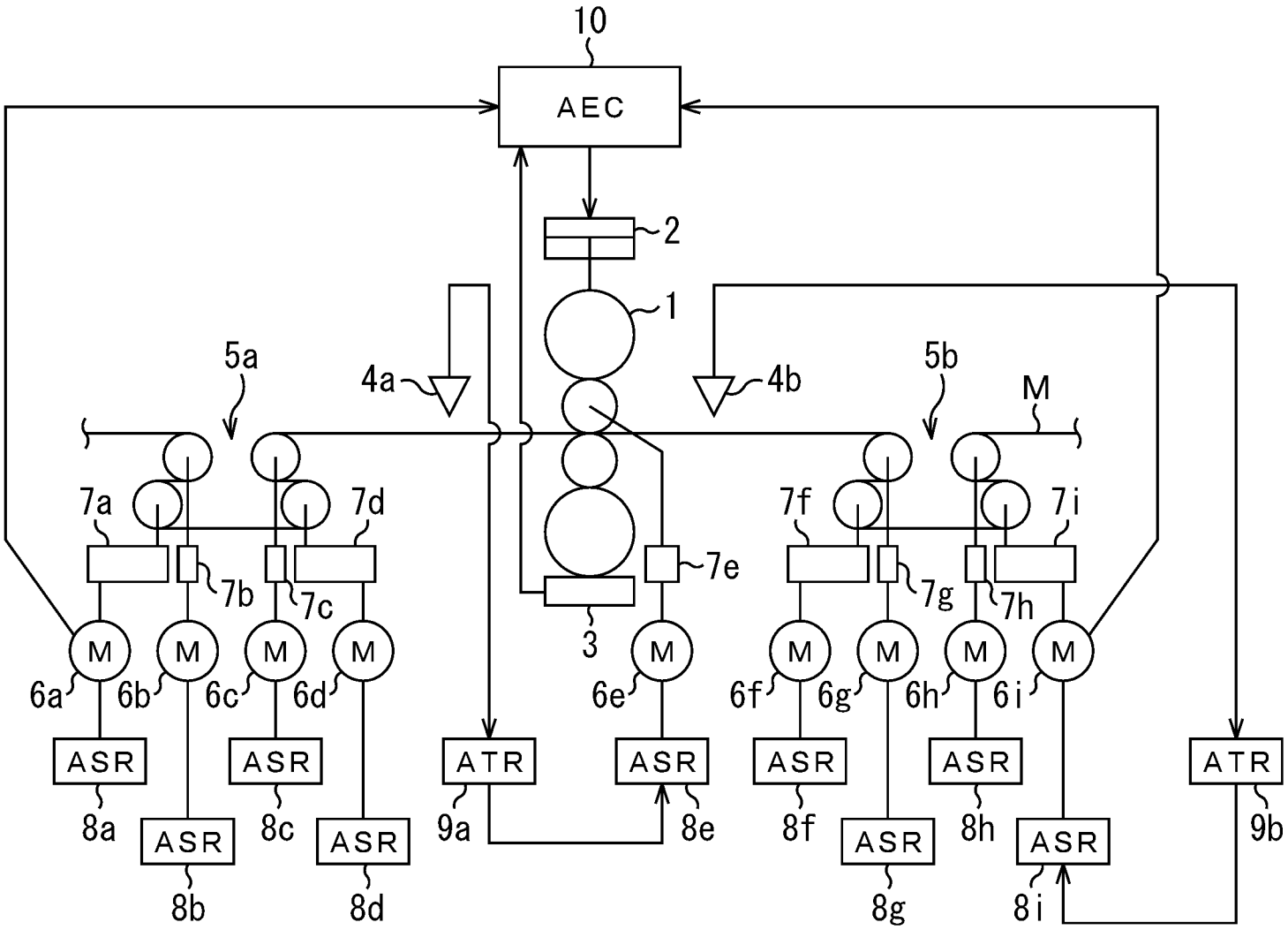
FIG. 1 is a diagram illustrating an example of a temper rolling facility.

FIG. 1 is a diagram illustrating an example of a temper rolling facility (rolling system).

A temper rolling mill 1 performs temper rolling on a steel sheet M, which is an example of a metal sheet. The temper rolling mill 1 includes, for example, a pair of work rolls and a pair of backup rolls.

A reduction position control device 2 controls a reduction position of the temper rolling mill 1 based on a reduction command from a rolling control device 10.

A load cell 3 measures the load (what is called a rolling load) of the temper rolling mill 1.

An entry-side tension meter 4*a* measures the entry-side tension of the steel sheet M. The entry-side tension of the steel sheet M is the tension of the steel sheet M on the entry side of the temper rolling mill 1.

An exit-side tension meter 4*b* measures the exit-side tension of the temper rolling mill 1. The exit-side tension of the steel sheet M is the tension of the steel sheet M on the exit side of the temper rolling mill 1.

An entry-side bridle roll 5*a* is a roll for conveying the steel sheet M toward the temper rolling mill 1 by regulating the conveying direction of the steel sheet M conveyed from the upstream side.

An exit-side bridle roll 5*b* is a roll for conveying the steel sheet M downstream by regulating the conveying direction of the steel sheet M temper-rolled by the temper rolling mill 1.

Electric motors 6*a* to 6*d* are electric motors for rotating the entry-side bridle roll 5*a*. Decelerators 7*a*, 7*b*, 7*c*, and 7*d* are arranged between the electric motors 6*a*, 6*b*, 6*c*, and 6*d* and rolls of the entry-side bridle roll 5*a* respectively. Pulse generators are attached to the electric motors 6*a* to 6*d*. The pulse generators generate pulse signals in response to the rotations of the electric motors 6*a* to 6*d*. In this embodiment, there is explained, as an example, the case where an entry-side velocity $V_1$ of the steel sheet M is measured based on the pulse signals generated from the pulse generators. The entry-side velocity $V_1$ of the steel sheet M is the velocity of the steel sheet M on the entry side of the temper rolling mill 1. However, the entry-side velocity $V_1$ of the steel sheet M may be measured by a sheet velocimeter.

An electric motor 6*e* is an electric motor for rotating the work rolls of the temper rolling mill 1. A decelerator 7*e* is arranged between the electric motor 6*e* and the work rolls of the temper rolling mill 1. A pulse generator is attached to the electric motor 6*e*.

Electric motors 6*f* to 6*i* are electric motors for rotating the exit-side bridle roll 5*b*. Decelerators 7*f*, 7*g*, 7*h*, and 7*i* are arranged between the electric motors 6*f*, 6*g*, 6*h*, and 6*i* and rolls of the exit-side bridle roll 5*b* respectively. Pulse generators are attached to the electric motors 6*f* to 6*i*. In this embodiment, there is explained, as an example, the case where an exit-side velocity $V_2$ of the steel sheet M is measured based on pulse signals generated from the pulse generators. The exit-side velocity $V_2$ of the steel sheet M is the velocity of the steel sheet M on the exit side of the temper rolling mill 1. However, the exit-side velocity $V_2$ of the steel sheet M may be measured by a sheet velocimeter.

Velocity control devices 8*a*, 8*b*, 8*c*, and 8*d* control rotational velocities of the electric motors 6*a*, 6*b*, 6*c*, and 6*d* respectively. The velocity control devices 8*a*, 8*b*, 8*c*, and 8*d* control the rotational velocities of the electric motors 6*a*, 6*b*, 6*c*, and 6*d* so that the rotational velocities of the electric motors 6*a*, 6*b*, 6*c*, and 6*d*, for example, correspond to the set velocity of the entry-side velocity $V_1$ of the steel sheet M.

A velocity control device 8*e* controls a rotational velocity of the electric motor 6*e* based on a velocity command output from a tension control device 9*a*.

Velocity control devices 8*f*, 8*g*, 8*h*, and 8*i* control rotational velocities of the electric motors 6*f*, 6*g*, 6*h*, and 6*i* based on velocity commands output from a tension control device 9*b* respectively.

Incidentally, the velocity control devices 8*a* to 8*i* are each referred to as an ASR (Automatic Speed Regulator).

The tension control device 9*a* outputs a velocity command for the work rolls of the temper rolling mill 1 based on the entry-side tension of the steel sheet M measured by the entry-side tension meter 4*a*. The tension control device 9*a* derives and outputs the velocity command for the work rolls of the temper rolling mill 1 by performing a feedback control so that the entry-side tension of the steel sheet M measured by the entry-side tension meter 4*a* becomes a target tension, for example.

The tension control device 9*b* outputs a velocity command for the exit-side bridle roll 5*b* based on the exit-side tension of the steel sheet M measured by the exit-side tension meter 4*b*. The tension control device 9*b* derives and outputs the velocity command for the exit-side bridle roll 5*b* by, for example, performing a feedback control so that the exit-side tension of the steel sheet M measured by the exit-side tension meter 4*b* becomes a target tension. Incidentally, in FIG. 1, only the arrow line from the tension control device 9*b* to the velocity control device 8*i* is illustrated for convenience of notation. However, the tension control device 9*b* outputs velocity commands for the exit-side bridle roll 5*b* also to the velocity control devices 8*f* to 8*h*. The tension control device 9*b* outputs the same velocity command to the velocity control devices 8*f* to 8*i*, for example. The same velocity command is a command to rotate the electric motors 6*f* to 6*i* at the same velocity.

The tension control devices 9*a* to 9*b* are each referred to as an ATR (Automatic tension Regulator).

The rolling control device 10 generates and outputs a reduction command by performing a feedback control so that the elongation rate of the steel sheet M becomes the target value based on the entry-side velocity $V_1$ and the exit-side velocity $V_2$ of the steel sheet M. Further, the rolling control device 10 generates and outputs a reduction command based on the rolling load measured by the load cell 3 when a welded portion WP of the steel sheet M is near the temper rolling mill 1. The reduction command includes a command value of the rolling load. Incidentally, in FIG. 1, only the arrow lines from the electric motors 6*a*, 6*i* to the rolling control device 10 are illustrated for convenience of notation. However, the pulse generators attached to the electric motors 6*b* to 6*d* and 6*f* to 6*h* also output information on the pulse signals generated by the pulse generators to the rolling control device 10.

The control by the rolling control device 10 is referred to as AEC (Auto Elongation Control). The AEC itself is a well-known technique as described in Non-Patent Literature 1. However, the specific processing for performing the AEC differs from the processing described in Non-Patent Literature 1.

Further, the temper rolling facility itself is achieved by a well-known technique as described in Patent Literature 1, or the like. Therefore, the temper rolling facility itself is not limited to the one illustrated in FIG. 1.

<Outline of Temper Rolling>

Figure 2:
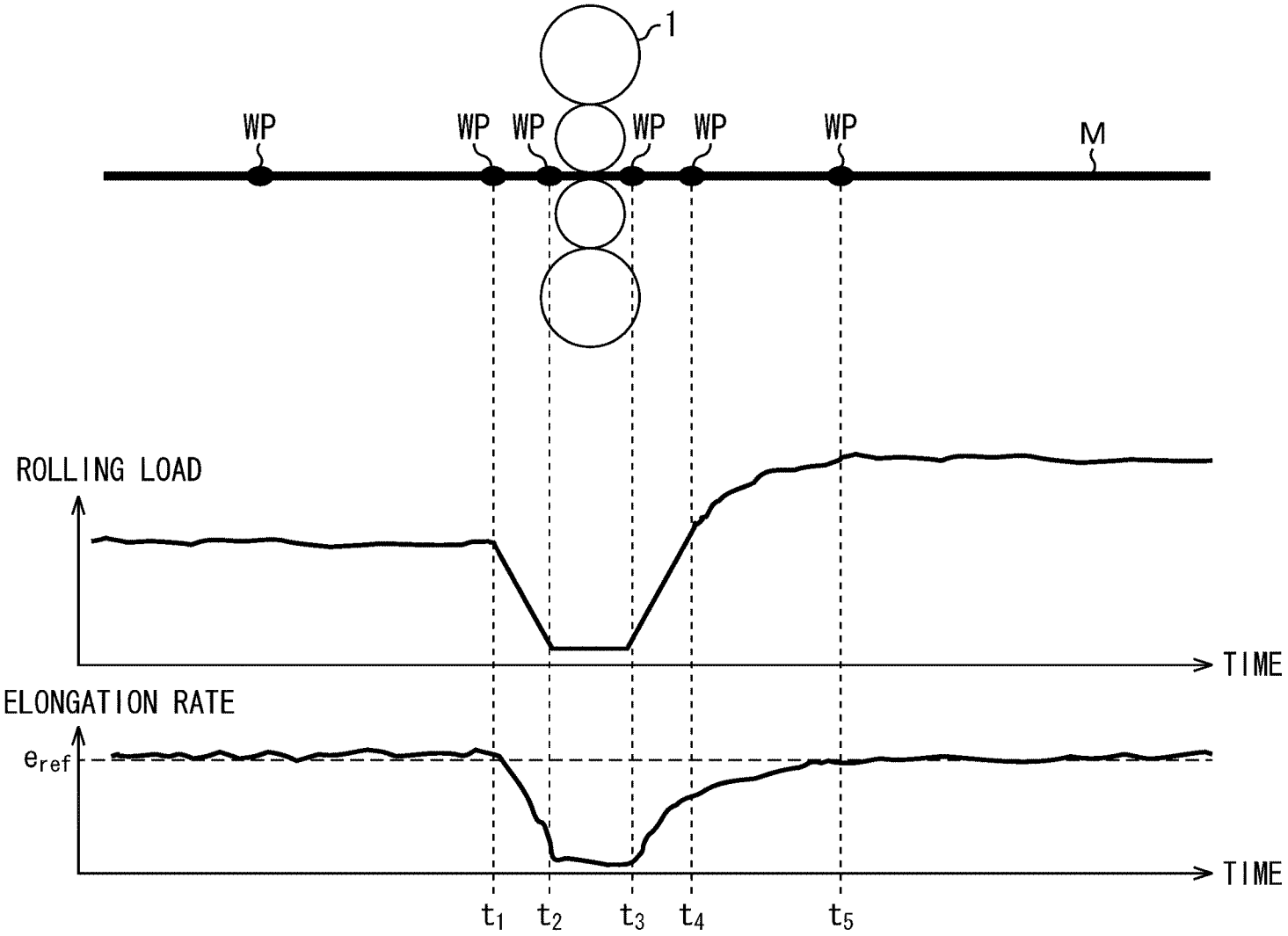
FIG. 2 is a view illustrating an example of the outline of temper rolling.

FIG. 2 is a view illustrating an example of the outline of temper rolling.

The top view in FIG. 2 illustrates the position of the welded portion WP of the steel sheet M at each time. That is, the top view in FIG. 2 illustrates how one welded portion WP moves over time. A plurality of the welded portions WP illustrated in the top view in FIG. 2 are the same welded portions. The middle graph in FIG. 2 is a graph illustrating the relationship between a rolling load and a time. The bottom graph in FIG. 2 is a graph illustrating the relationship between an elongation rate of the steel sheet M and a time. The dashed lines attached to timings $t_1$ to $t_5$ is indicate that the values of the rolling loads and the elongation rates when the welded portions WP are at the positions in the top view at the timings $t_1$ to $t_5$ is are the values of the intersecting points of the dashed lines with the middle and bottom graphs respectively.

In the temper rolling facility, in order to continuously temper-roll a plurality of coils (coiled steel sheets), the tail end of the preceding coil and the leading end of the following coil are welded. The portion where they are welded in this manner is the welded portion WP. The region containing the welded portion WP is not used as a product. Further, if the temper rolling mill 1 performs temper rolling on the welded portion WP in the same manner as other regions of the steel sheet M, there are problems such as scratches formed on the rolling rolls and breakage of the coil at the welded portion WP.

Then, as illustrated in FIG. 2, at the timing $t_1$ when the welded portion WP has reached a predetermined position on the entry side of the temper rolling mill 1, the rolling control device 10 stops the feedback control based on the entry-side velocity $V_1$ and the exit-side velocity $V_2$ of the steel sheet M. As a result, the rolling load decreases to a predetermined value before the welded portion WP reaches the temper rolling mill 1. Therefore, the temper rolling mill 1 is brought into a soft reduction state (in FIG. 2, the timing when the rolling load has become a predetermined value is $t_2$). Incidentally, the soft reduction state means that the rolling load of the temper rolling mill 1 exceeds 0 (zero) and falls below the rolling load when the elongation rate of the steel sheet M is controlled. The soft reduction state is preferably a state where the work rolls of the temper rolling mill 1 are in contact with the welded portion WP and the region near the welded portion WP while the elongation rate of the steel sheet M remains unvaried. Further, instead of bringing the temper rolling mill 1 into a soft reduction state, rolling by the temper rolling mill 1 may be suspended (what is called a mill open state may be made). To suspend the rolling by the temper rolling mill 1 means setting the rolling load of the temper rolling mill 1 to 0 (zero). Thus, the welded portion WP passes through the temper rolling mill 1 in a state where the rolling load is smaller than the rolling load when the elongation rate of the steel sheet M is controlled.

Then, when the welded portion WP reaches a predetermined position on the exit side of the temper rolling mill 1, the rolling control device 10 controls the reduction position of the temper rolling mill 1 so that the rolling load of the steel sheet M becomes a preset load value. That is, the rolling control device 10 uses the preset load value as the target rolling load to control the reduction position of the temper rolling mill 1. At this time, for example, the temper rolling mill 1 performs operations that include reducing the steel sheet M with a maximum load and reducing the steel sheet M so that the rolling load per unit time is constant. In the following explanation, the preset load value is referred to as a preset load value as required. Incidentally, the initial value of the preset load value is set in advance before the temper rolling of the steel sheet M is started based on the result of setup calculation. In the following explanation, the initial value of the preset load value is referred to as an initial preset load value as required. In the setup calculation, calculations necessary for making various settings for the temper rolling facility are executed so that the elongation rate of the steel sheet M becomes the target value. Incidentally, the setup calculation itself is executed by the calculation executed in the existing temper rolling facility. Therefore, a detailed explanation of the setup calculation is omitted here.

In FIG. 2, the timing when the welded portion WP has reached a predetermined position on the exit side of the temper rolling mill 1 is $t_3$. Thereafter, it is assumed that an elongation rate e of the steel sheet M becomes a target value $e_{ref}$ at the timing is after the timing $t_4$. When the elongation rate e of the steel sheet M becomes the target value $e_{ref}$, the rolling control device 10 resumes the feedback control based on the previously-described entry-side velocity $V_1$ and exit-side velocity $V_2$ of the steel sheet M. Here, instead of the elongation rate e of the steel sheet M becoming the target value $e_{ref}$, the error of the elongation rate e of the steel sheet M with respect to the target value $e_{ref}$ may fall within a predetermined target range.

Incidentally, the position of the welded portion WP is specified, for example, by executing tracking of the steel sheet M. The tracking of the steel sheet M is achieved, for example, by specifying the position of the welded portion WP based on the position of a welding device and the entry-side velocity $V_1$ and the exit-side velocity $V_2$ of the steel sheet M. The tracking itself of the steel sheet M is implemented by a well-known technique. Therefore, a detailed explanation of the tracking of the steel sheet M is omitted here.

<Findings>

There are explained the findings obtained by the present inventors.

One of the objects of the rolling control device 10 in this embodiment is to solve the problems of the technique described in Patent Literature 1 regarding the control of the reduction position of the temper rolling mill 1 during the period from the time when the welded portion WP reaches a predetermined position on the exit side of the temper rolling mill 1 to the time when the elongation rate e of the steel sheet M becomes the target value $e_{ref}$ (period during the timings $t_3$ to $t_5$). Incidentally, this period (period during the timings $t_3$ to $t_5$) may be the period from the time when the welded portion WP reaches a predetermined position on the exit side of the temper rolling mill 1 to the time when the error of the elongation rate e of the steel sheet M with respect to the target value $e_{ref}$ falls within a predetermined target range. Here, with reference to FIG. 3, there is explained one of the problems of the technique described in Patent Literature 1. Incidentally, the control of the reduction position of the temper rolling mill 1 during the period other than the above period (period other than the timings $t_3$ to $t_5$) can be implemented by a well-known technique. Therefore, a detailed explanation of this control is omitted in this embodiment.

Figure 3:
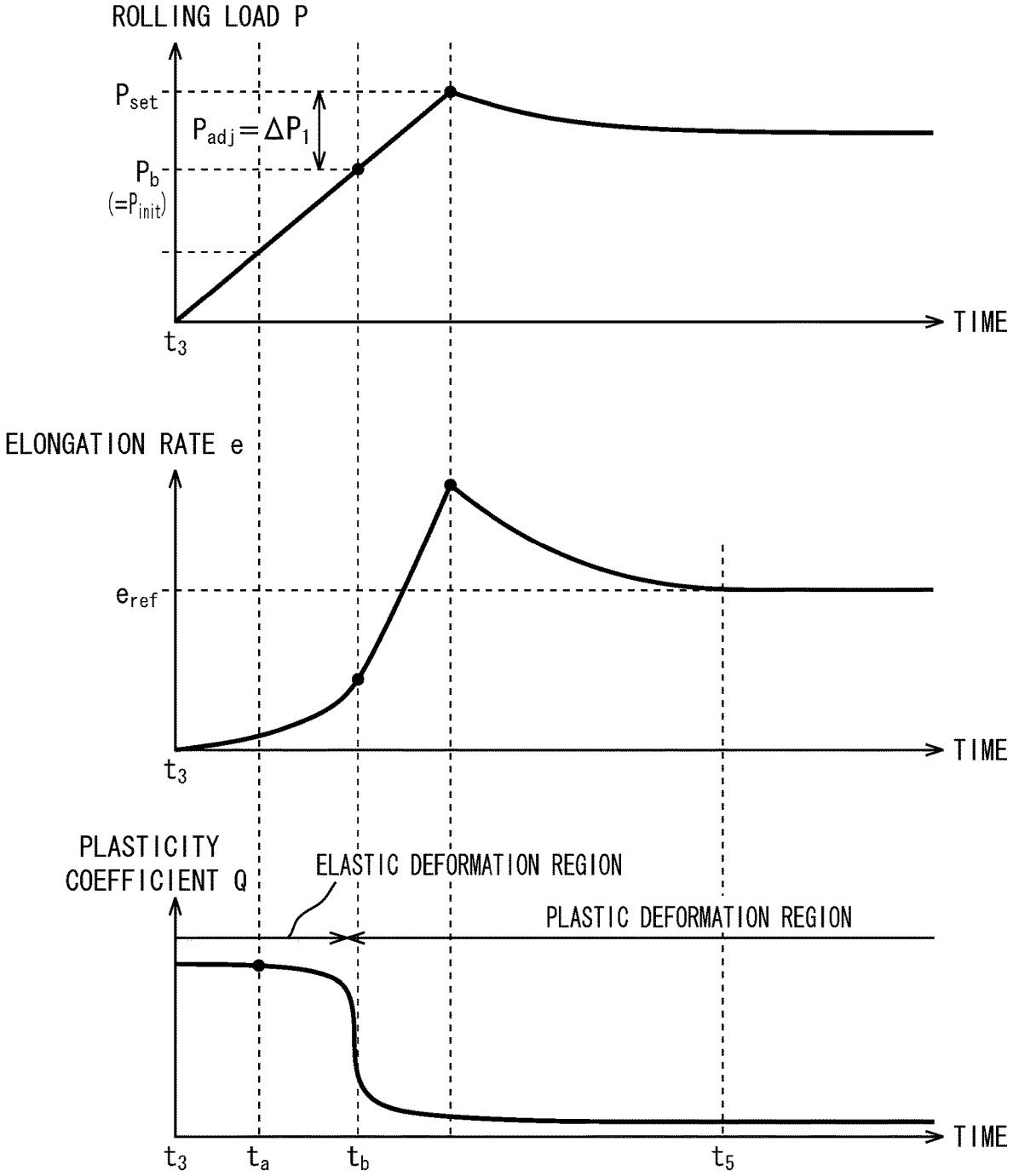
FIG. 3 is a view explaining the problem of the technique described in Patent Literature 1.

FIG. 3 is a view explaining the problem of the technique described in Patent Literature 1.

In the technique described in Patent Literature 1, an entry-side sheet thickness $H_1$ of the steel sheet M and a plasticity coefficient Q of the steel sheet M are derived based on a reduction position $S_a$, a rolling load $P_a$, and an elongation rate e a at a timing $t_a$ before the rolling load of the steel sheet M becomes an initial preset load value $P_{init}$, a reduction position $S_b$, a rolling load $P_b$, and an elongation rate $e_b$ at a timing $t_b$ when the rolling load of the steel sheet M has become the initial preset load value $P_{init}$, and the target value $e_{ref}$ of the elongation rate e. Here, the plasticity coefficient Q of the steel sheet M is the plasticity coefficient of the steel sheet M at the reduction position S (this is also the same in the following explanation). Further, the entry-side sheet thickness $H_1$ of the steel sheet M is the sheet thickness of the steel sheet M at the entry-side position of the temper rolling mill 1 (this is also the same in the following explanation). Then, a correction amount $P_{adj1}(=\Delta P_1)$ of the rolling load for the initial preset load value $P_{init}$ is derived based on the entry-side sheet thickness $H_1$ and the plasticity coefficient Q of the steel sheet M. Then, the value obtained by adding the correction amount $P_{adj1}$ to the initial preset load value $P_{init}$ is derived as a new preset load value $P_{set}$. Once the new preset load value $P_{set}$ is derived, the reduction position of the steel sheet M is controlled so that the rolling load of the steel sheet M becomes the preset load value $P_{set}$.

In FIG. 3, the new preset load value $P_{set}$ is derived by using the plasticity coefficient Q derived based on pieces of information (the reduction positions $S_a$ and $S_b$, the rolling loads P a and $P_b$, and the elongation rates e a and $e_b$) at the timings $t_a$ and $t_b$. Therefore, the new preset load value $P_{set}$ relies on the plasticity coefficient Q during the period from the timing $t_a$ to the timing $t_b$. As illustrated in FIG. 3, the present inventors found out that there is a steel sheet M whose plasticity coefficient Q decreases significantly near the initial preset load value $P_{init}$. The reason why the plasticity coefficient Q of the steel sheet M decreases significantly near the initial preset load value $P_{init}$ is thought to be because the deformation of the steel sheet M changes from elastic deformation to plastic deformation when temper rolling is performed with the rolling load near the initial preset load value $P_{init}$. Here, in the bottom graph in FIG. 3, the period indicated as an elastic deformation region conceptually indicates the period when the elastic deformation is dominant as the deformation of the steel sheet M. The period indicated as a plastic deformation region conceptually indicates the period when the plastic deformation is dominant as the deformation of the steel sheet M. As the timing is closer to the boundary between the period indicated as the elastic deformation region and the period indicated as the plastic deformation region, it becomes less clear which of the elastic deformation and the plastic deformation is dominant.

In such a steel sheet M, as illustrated in the bottom graph of FIG. 3, the plasticity coefficient Q during the period from the timing $t_a$ to the timing $t_b$ is significantly different from the plasticity coefficient Q after the timing $t_b$. Therefore, the new preset load value $P_{set}$ derived based on the plasticity coefficient Q during the period from the timing $t_a$ to the timing $t_b$ will be a value that does not correspond to the actual plasticity coefficient Q (see the top graph in FIG. 3). Thus, when the reduction position of the steel sheet M is controlled so that the rolling load of the steel sheet M becomes the preset load value $P_{set}$, the elongation rate e of the steel sheet M greatly exceeds the target value $e_{ref}$, as illustrated in the middle graph in FIG. 3. Therefore, the time until the elongation rate e of the steel sheet M approaches the target value $e_{ref}$ (namely, the present time reaches the timing $t_5$) becomes longer (see the middle graph in FIG. 3). Thus, the present inventors found out that when the plasticity coefficient Q of the steel sheet M varies significantly, the time required to converge the elongation rate e of the steel sheet M to the target value $e_{ref}$ or to the vicinity of the target value can be shortened as long as the preset load value $P_{set}$ is updated again. Each of the embodiments of the present invention has been made based on such findings.

Incidentally, in FIG. 3, in order to simplify the explanation, there is explained, as an example, the case where the preset load value $P_{set}$ is updated only once. However, the update of the preset load value $P_{set}$ may be performed repeatedly. When the update of the preset load value $P_{set}$ is performed repeatedly, processing to replace the initial preset load value Pint with a new preset load value is performed and the preset load value is updated in the following explanation.

<Rolling Control Device 10>

Figure 4:
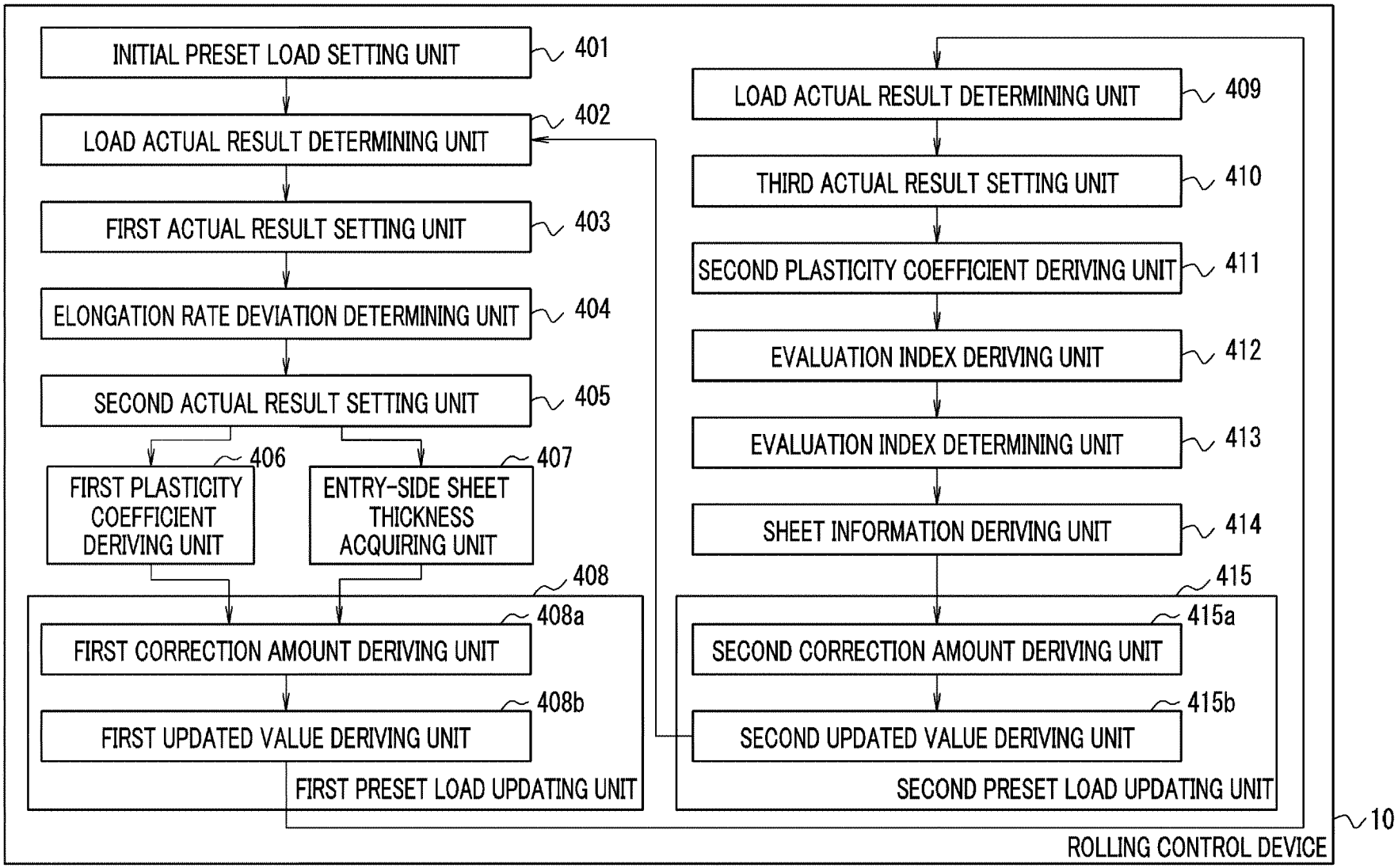
FIG. 4 is a diagram illustrating a first example of a functional configuration of a rolling control device.
Figure 5A:
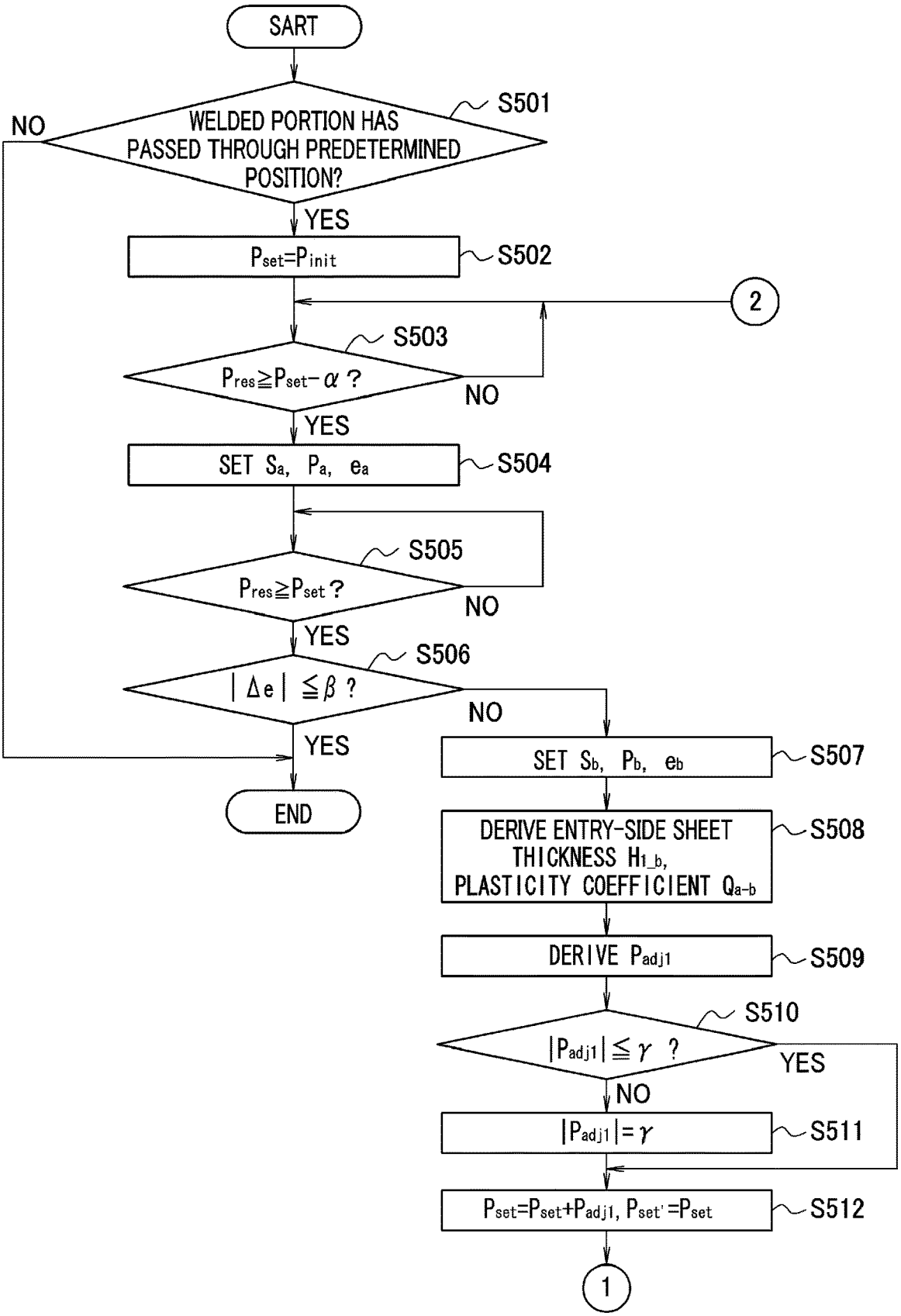
FIG. 5A is a flowchart explaining an example of a rolling control method.
Figure 5B:
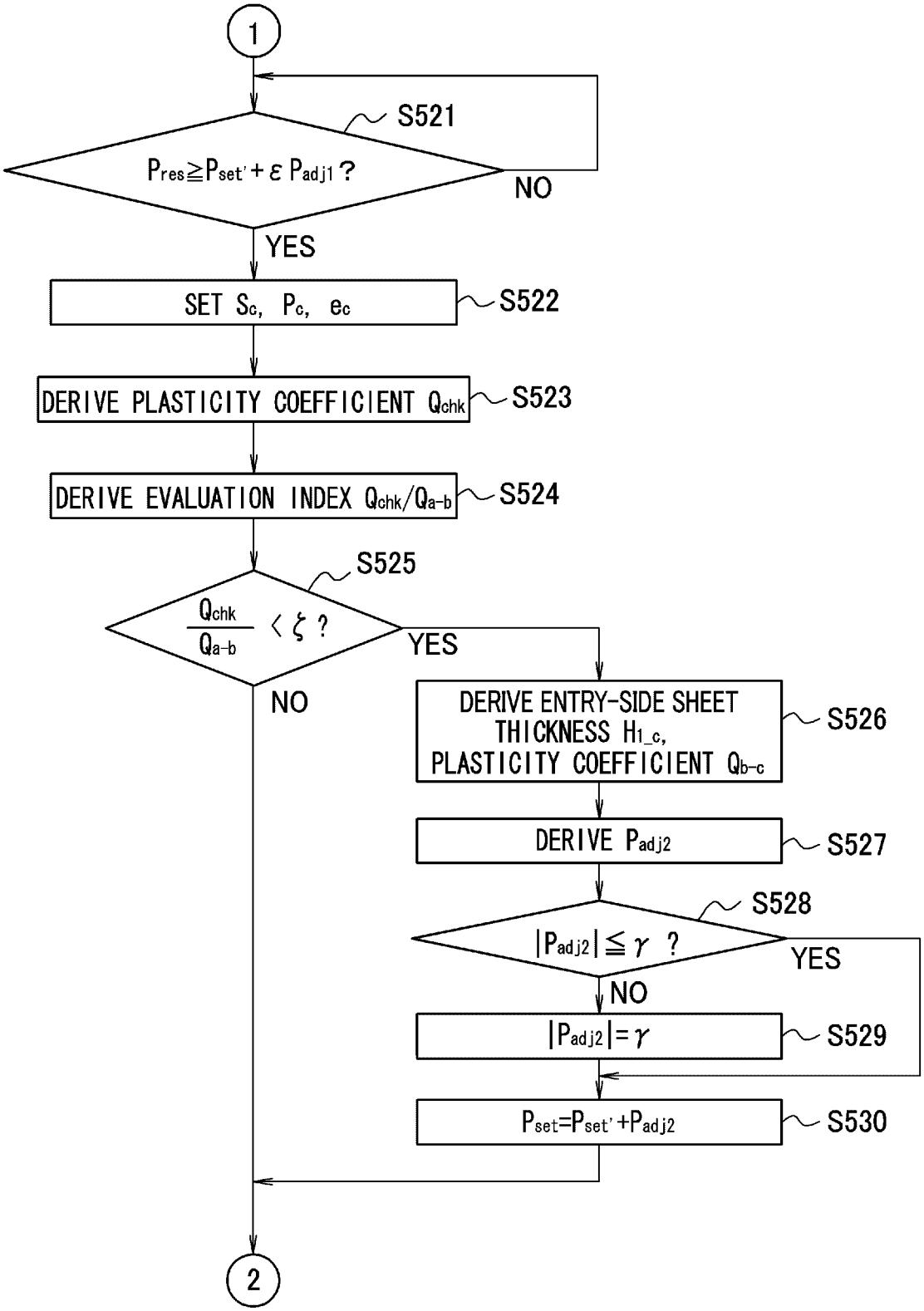
FIG. 5B is a view illustrating a first example of a flowchart following FIG. 5A.
Figure 6:
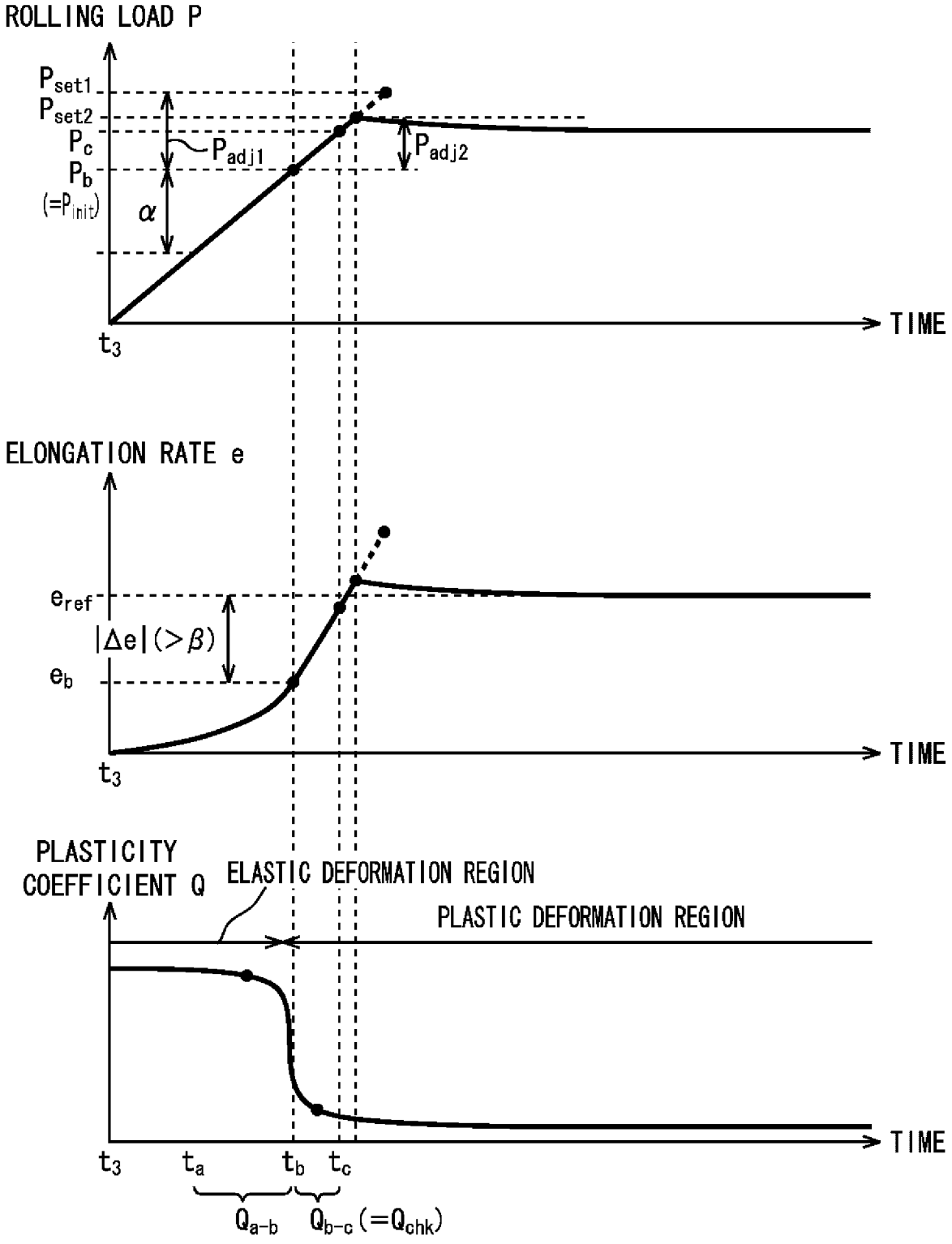
FIG. 6 is a view conceptually explaining an example of processing of the rolling control device.

FIG. 4 is a diagram illustrating an example of a functional configuration of the rolling control device 10. FIG. 5A and FIG. 5B each are a flowchart explaining an example of a rolling control method executed by using the rolling control device 10. FIG. 6 is a view conceptually explaining an example of pieces of processing of the rolling control device 10. Incidentally, as described previously, in this embodiment, there is explained the control during the period from the time when the welded portion WP reaches a predetermined position on the exit side of the temper rolling mill 1 to the time when the elongation rate e of the steel sheet M becomes the target value $e_{ref}$ (period during the timings $t_3$ to $t_5$). Incidentally, as described previously, this period (period during the timings $t_3$ to $t_5$) may be the period from the time when the welded portion WP reaches a predetermined position on the exit side of the temper rolling mill 1 to the time when the error of the elongation rate e of the steel sheet M with respect to the target value $e_{ref}$ falls within the predetermined target range.

With reference to FIG. 5A, FIG. 5B, and FIG. 6, there is explained an example of processing of each functional block of the rolling control device 10 illustrated in FIG. 4.

At Step S501 in FIG. 5A, an initial preset load setting unit 401 determines whether or not the welded portion WP of the steel sheet M has passed through the predetermined position on the exit side of the temper rolling mill 1 based on the result of tracking of the steel sheet M. The determination at Step S501 is equivalent to the determination as to whether or not the present time has reached the timing $t_3$ in FIG. 6. As a result of the determination at Step S501, when the welded portion WP of the steel sheet M does not pass through the predetermined position on the exit side of the temper rolling mill 1, the processing in FIG. 5A and FIG. 5B is finished. In this case, the flowchart in FIG. 5A is started again to determine whether or not the next welded portion WP has passed through the predetermined position on the exit side of the temper rolling mill 1.

On the other hand, at Step S501 when it is determined that the welded portion WP of the steel sheet M has passed through the predetermined position on the exit side of the temper rolling mill 1, the processing at Step S502 is executed. At Step S502, the initial preset load setting unit 401 sets the preset load value $P_{set}$ of the steel sheet M to the initial preset load value $P_{init}$. Then, the initial preset load setting unit 401 outputs a reduction command including the preset load value $P_{set}$ of the steel sheet M to the reduction position control device 2. Thereby, in FIG. 6, the reduction position control device 2 changes the reduction position of the temper rolling mill 1 so that the rolling load of the steel sheet M approaches the initial preset load value $P_{init}$.

Then, at Step S503, a load actual result determining unit 402 determines whether or not a measured value $P_{res}$ of the rolling load of the steel sheet M is equal to or more than the value obtained by subtracting a constant $\alpha$ from the preset load value $P_{set}$ ($=P_{set}-\alpha$). When the measured value $P_{res}$ of the rolling load of the steel sheet M is not equal to or more than the value obtained by subtracting the constant $\alpha$ from the preset load value $P_{set}$($=P_{set}-\alpha$), the processing at Step S503 is executed again. The load actual result determining unit 402 repeatedly acquires the measured value $P_{res}$ of the rolling load of the steel sheet M in a control cycle of the rolling control device 10.

The latest measured value $P_{res}$ of the rolling load of the steel sheet M is used for the determination at Step S503. The determination at Step S503 is equivalent to the determination as to whether or not the present time has reached the timing $t_a$ in FIG. 6 after the welded portion WP reaches the predetermined position on the exit side of the temper rolling mill 1. If the period from the timing $t_a$ to the timing $t_b$ is too short, there is a possibility that the calculation accuracy will deteriorate due to the effect of various sensor errors. The various sensor errors include, for example, errors due to noise, quantization errors, measurement variations, and so on. The constant $\alpha$ is set in advance so as not to cause such deterioration in calculation accuracy. For example, the constant $\alpha$ is set so that the absolute value of the difference between the rolling load at the timing $t_a$ and the rolling load at the timing $t_b$ is 50 tons or more.

As a result of the determination at Step S503, when the measured value $P_{res}$ of the rolling load of the steel sheet M becomes equal to or more than the value obtained by subtracting the constant $\alpha$ from the preset load value $P_{set}$ ($=P_{set}-\alpha$) 1 the processing at Step S504 is executed. At Step S504, a first actual result setting unit 403 sets the reduction position $S_a$, the rolling load $P_a$, and the elongation rate e a at the timing $t_a$. In this embodiment, the timing $t_a$ is an example of a first timing. The elongation rate e is derived from (1) Equation and (2) Equation below as described in Patent Literature 1.

$$e=\{(V_{2_ref}-V_1)/V_1\}-\Delta V_2/V_1 \quad (1)$$

$$\Delta V_2=V_{2_ref}-V_2 \quad (2)$$

Here, $V_{2_ref}$ is the target value of the exit-side velocity $V_2$ of the steel sheet M. $V_{2_ref}$ is set in advance based on attributes or the like of the steel sheet M. In this embodiment, the entry-side velocity $V_1$ and the exit-side velocity $V_2$ of the steel sheet M are derived based on the pulse signals generated by the pulse generators attached to the electric motors 6*a* to 6*d* and 6*f* to 6*i*.

Further, the reduction position S is the reduction position that is adjusted by the reduction position control device 2. Therefore, the first actual result setting unit 403 acquires the reduction position from the reduction position control device 2. The rolling load P is the measured value of the rolling load measured by the load cell 3. Therefore, the first actual result setting unit 403 acquires the rolling load from the load cell 3.

Then, at Step S505, an elongation rate deviation determining unit 404 determines whether or not the measured value $P_{res}$ of the rolling load of the steel sheet M is the preset load value $P_{set}$. When the measured value $P_{res}$ of the rolling load of the steel sheet M is not the preset load value $P_{set}$, the processing at Step S505 is executed again. When these pieces of the processing are performed consecutively in the order of Steps S502, S503, S504, and S505, the preset load value $P_{set}$ is the initial preset load value Pipit (see Step S502). In this case, the determination at Step S505 is equivalent to the determination as to whether or not the present time has reached the timing $t_b$ in FIG. 6.

As a result of the determination at Step S505, when the measured value P res of the rolling load of the steel sheet M becomes the preset load value $P_{set}$, the processing at Step S506 is executed. At Step S506, the elongation rate deviation determining unit 404 derives the elongation rate $e_b$ of the steel sheet M at the timing when the measured value $P_{res}$ of the rolling load of the steel sheet M has become the preset load value $P_{set}$ from (1) Equation and (2) Equation. Then, the elongation rate deviation determining unit 404 derives an elongation rate deviation Δe at the timing when the measured value $P_{res}$ of the rolling load of the steel sheet M has become the preset load value $P_{set}$. The elongation rate deviation 1*e* is the deviation between the elongation rate $e_b$ of the steel sheet M and the target value $e_{ref}$. Then, the elongation rate deviation determining unit 404 determines whether or not the absolute value of the elongation rate deviation Δe is equal to or less than a constant β. The constant β indicates how much error is allowed as the elongation rate deviation Δe. The constant β is set in advance based on the attributes or the like of the steel sheet M.

As has been explained with reference to FIG. 2, when the elongation rate $e_b$ of the steel sheet M at the timing when the measured value $P_{res}$ of the rolling load of the steel sheet M has become the preset load value $P_{set}$ is the target value $e_{ref}$, the feedback control based on the entry-side velocity $V_1$ and the exit-side velocity $V_2$ of the steel sheet M is resumed. Thus, as a result of the determination at Step S506, when the absolute value of the elongation rate deviation Δe is equal to or less than the constant β, the processing according to the flowcharts in FIG. 5A and FIG. 5B is finished and the feedback control is resumed. Further, the feedback control based on the entry-side velocity $V_1$ and the exit-side velocity $V_2$ of the steel sheet M may be resumed when the error of the elongation rate $e_b$ of the steel sheet M with respect to the target value $e_{ref}$ at the timing when the measured value $P_{res}$ of the rolling load of the steel sheet M has become the preset load value $P_{set}$ is within the target range.

On the other hand, as a result of the determination at Step S506, when the absolute value of the elongation rate deviation Δe is not equal to or less than the constant β, the processing at Step S507 is executed. When these pieces of the processing are performed consecutively in the order of Steps S502, S503, S504, S505, and S506, the preset load value $P_{set}$ is the initial preset load value $P_{init}$ (see Step S502). The example illustrated in the middle graph in FIG. 6 indicates that an absolute value |Δe| of the elongation rate deviation Δe is not equal to or less than the constant β.

At step S507, a second actual result setting unit 405 sets the reduction position $S_b$, the rolling load $P_b$, and the elongation rate $e_b$ at the timing $t_b$. Incidentally, the method of setting the reduction position S, the rolling load P, and the elongation rate e is as explained in the processing at Step S504. Further, the elongation rate $e_b$ at the timing $t_b$ may be the elongation rate $e_b$ derived at Step S506.

Then, at Step S508, a first plasticity coefficient deriving unit 406 derives a plasticity coefficient $Q_{a-b}$ based on the reduction position $S_a$ and the rolling load P a at the timing $t_a$ set at Step S504 and the reduction position $S_b$ and the rolling load $P_b$ at the timing $t_b$ set at Step S507. The plasticity coefficient $Q_{a-b}$ corresponds to the general value of the plasticity coefficient Q during the period from the timing $t_a$ to the timing $t_b$. The general value is the general (overall) value during the period, which is typically the mean value or median value during that period. Further, an entry-side sheet thickness acquiring unit 407 derives an entry-side sheet thickness $H_{1_b}$ of the steel sheet M at the timing $t_b$ based on the reduction position $S_a$, the rolling load $P_a$, and the elongation rate e a at the timing $t_a$ set at Step S504 and the reduction position $S_b$, the rolling load $P_b$, and the elongation rate $e_b$ at the timing $t_b$ set at Step S507.

In this embodiment, the period from the timing $t_a$ to the timing $t_b$ is an example of a first period. Further, in this embodiment, the value of the reduction position $S_a$ and the value of the rolling load P a at the timing $t_a$ are examples of operation actual result values at the first timing used when deriving the plasticity coefficient $Q_{a-b}$. Further, in this embodiment, the value of the reduction position $S_b$ and the value of the rolling load $P_b$ at the timing $t_b$ are examples of operation actual result values at a second timing used when deriving the plasticity coefficient $Q_{a-b}$ Further, in this embodiment, the first plasticity coefficient deriving unit 406 is an example of a first plasticity coefficient deriving means. Here, the operation actual result values are actual result values obtained by actually performing the temper rolling on the steel sheet M at the temper rolling mill 1. The operation actual result values include, for example, values that indicate the attributes of the steel sheet M (for example, characteristics of the steel sheet M) and values that indicate the results of the operation of the temper rolling mill 1. Further, the operation actual result values include at least one of the measured value and the calculated value. Incidentally, the values indicating the results of the operation of the temper rolling mill 1 included in the operation actual result values are not limited to the value of the reduction position S or the value of the rolling load P. For example, the values indicating the results of the operation of the temper rolling mill 1 included in the operation actual result values may include at least any one of the following (a1) to (a7) in addition to or instead of the value of the reduction position S and the value of the rolling load P.

(a1) Actual result value of the rotational velocity of the work rolls of the temper rolling mill 1

(a2) Actual result value of the rotational velocity of the entry-side bridle roll 5*a*

(a3) Actual result value of the tension of the steel sheet M on the entry side of the temper rolling mill 1, measured by the entry-side tension meter 4*a*

(a4) Actual result value of the tension of the steel sheet M on the exit side of the temper rolling mill 1, measured by the exit-side tension meter 4*b*

(a5) Actual result value of the elongation rate e of the steel sheet M (a6) Actual result value of the exit-side sheet thickness of the steel sheet M (sheet thickness of the steel sheet M at the exit-side position of the temper rolling mill 1)

(a7) Actual result value of the rotational velocity of the exit-side bridle roll 5*b*

The plasticity coefficient Q and the entry-side sheet thickness $H_1$ are derived from (3) Equation and Equation (4) below, as described in Patent Literature 1. That is, the plasticity coefficient Q is derived by (3) Equation. The entry-side sheet thickness $H_{1_b}$ is derived based on the plasticity coefficient Q and (4) Equation.

$$Q=(P_j-P_i)/\{1/M\times(P_j-P_i)+(S_j-S_i)\} \quad (3)$$

$$H_1=(P_j-P_i)/Q\{1/(e_j+1)-1/(e_1+1)\} \quad (4)$$

Here, subscripts i and j indicate the values at timings i and j, and j indicates the timing after i. At Step S508, i is a and j is b. M is the mill constant.

Incidentally, as described in Patent Literature 1, the value of the entry-side sheet thickness $H_1$ of the steel sheet M may be a value measured by a sheet thickness meter.

Then, at Step S509, a first correction amount deriving unit 408*a* (first preset load updating unit 408) derives the correction amount $P_{adj1}$ of the rolling load based on the elongation rate $e_b$ at the timing $t_b$ set at Step S507, the entry-side sheet thickness $H_{1_b}$ and the plasticity coefficient $Q_{a\text{-}b}$ at the timing $t_b$ derived at Step S508, and the target value $e_{ref}$ of the elongation rate e.

In this embodiment, the first preset load updating unit 408 including the first correction amount deriving unit 408*a* is an example of a first preset load updating means. Further, in this embodiment, the first correction amount deriving unit 408*a* is an example of a first correction amount deriving means. Further, in this embodiment, the value of the elongation rate $e_b$, the value of the entry-side sheet thickness $H_{1_b}$, and the value of the plasticity coefficient $Q_{a\text{-}b}$ are examples of the operation actual result values during the first period used when deriving the correction amount $P_{adj1}$ of the rolling load. Incidentally, the values indicating the attributes of the steel sheet M included in the operation actual result values are not limited to the value of the elongation rate e, the value of the entry-side sheet thickness $H_1$, or the value of the plasticity coefficient Q. For example, the values indicating the attributes of the steel sheet M included in the operation actual result values may include at least any one of the following (b1) to (b3) in addition to or instead of the value of the elongation rate e, the value of the entry-side sheet thickness $H_1$, and the value of the plasticity coefficient Q.

(b1) Value of a yield point (YP: Yield Point) of the steel sheet M (b2) Value of the entry-side sheet width of the steel sheet M (sheet width of the steel sheet M at the entry-side position of the temper rolling mill 1).

(b3) Mill constant (stiffness coefficient) of the temper rolling mill 1

Here, the value of the yield point of the steel sheet M may be a value that identifies any one of a plurality of sections defining the range of the yield point of the steel sheet M. A lower limit value and an upper limit value of the yield point of the steel sheet M are set for each of a plurality of the sections. In this case, it is determined to which of a plurality of the sections the value of the yield point of the steel sheet M belongs. The value for identifying the section determined in this manner is the value for identifying any one of a plurality of the sections defining the range of the yield point of the steel sheet M.

A correction amount $P_{adj}$ is derived from (5) Equation below as described in Patent Literature 1.

$$P_{adj}=Q\times H_1\times\{1/(e_{ref}+1)-1/(e+1)\} \quad (5)$$

Then, at Step S510, the first correction amount deriving unit 408*a* determines whether or not an absolute value $|P_{adj1}|$ the correction amount $P_{adj1}$ derived at Step S509 is equal to or less than a constant γ. The constant γ is used to prevent the absolute value $|P_{adj1}|$ the correction amount $P_{adj1}$ from becoming too large, and is set in advance from this viewpoint.

As a result of the determination at Step S510, when the absolute value IP a dill of the correction amount $P_{adj1}$ derived at Step S509 is equal to or less than the constant γ, the processing at Step S511 is omitted and the processing at Step S512, which will be described later, is executed. On the other hand, as a result of the determination at Step S510, when the absolute value $|P_{adj1}|$ of the correction amount $P_{adj1}$ derived at Step S509 is not equal to or less than the constant γ, the processing at Step S511 is executed.

At Step S511, the first correction amount deriving unit 408*a* modifies the correction amount $P_{adj1}$ derived at Step S509 so that the absolute value $|P_{adj1}|$ of the correction amount $P_{adj1}$ derived at Step S509 becomes the constant γ. At this time, the first correction amount deriving unit 408*a* sets the sign of the modified correction amount $P_{adj1}$ to be the same as the sign of the correction amount $P_{adj1}$ which is before the modification.

Then, at Step S512, a first updated value deriving unit 408*b* (the first preset load updating unit 408) derives the value obtained by adding the correction amount $P_{adj1}$ derived at Step S509 or S511 to the current value of the preset load value $P_{set}$ as a new preset load value $P_{set}$. Then, the first updated value deriving unit 408*b* outputs a reduction command including the new preset load value $P_{set}$ to the reduction position control device 2. Thereby, in FIG. 6, the reduction position control device 2 changes the reduction position of the temper rolling mill 1 so that the rolling load of the steel sheet M approaches the new preset load value $P_{set}$ (in the example illustrated in FIG. 6, the new preset load value $P_{set}$ is $P_{set1}$). When these pieces of the processing are consecutively performed in the order of Steps S502, S503, S504, S505, S506, S507, S508, S509, S510, and S512, the new preset load value $P_{set}$ becomes the sum of the initial preset load value $P_{init}$ and the correction amount $P_{adj1}$ derived at Step S509 ($P_{set}=P_{init}+P_{adj1}$). As described previously, in the example illustrated in FIG. 6, the new preset load value $P_{set}$ derived as above is $P_{set1}$.

Further, the first updated value deriving unit 408*b* sets the preset load value $P_{set}$ f which is before update, as a pre-update preset load value $P_{set'}$. The reason for setting the pre-update preset load value $P_{set'}$ is to use the pre-update preset load value $P_{set'}$ in the processing (at Steps S521 and S530) in FIG. 5B. When these pieces of the processing are consecutively performed in the order of Steps S502, S503, S504, S505, S506, S507, S508, S509, S510, and S512, the preset load value $P_{set}$, which is before update, is the initial preset load value $P_{init}$.

In this embodiment, the new preset load value $P_{set}$ ($P_{set1}$) is an example of an updated value of the preset load. Further, in this embodiment, the first preset load updating unit 408 including the first updated value deriving unit 408*b* is an example of the first preset load updating means. Further, in this embodiment, the first updated value deriving unit 408*b* is an example of a first updated value deriving means.

After the processing at Step S512 is finished, the processing at Step S521 in FIG. 5B is executed. At Step S521, a load actual result determining unit 409 determines whether or not the measured value $P_{res}$ of the rolling load of the steel sheet M is equal to or more than the sum of the pre-update preset load value $P_{set'}$ and the product of a constant ε and the correction amount $P_{adj1}$(=$P_{set'}$+ε$P_{adj1}$). When the measured value $P_{res}$ of the rolling load of the steel sheet M is not equal to or more than the sum of the pre-update preset load value $P_{set'}$ and the product of the constant c and the correction amount $P_{adj1}$(=$P_{set'}$+ε$P_{adj1}$), the processing at Step S521 is executed again. The correction amount $P_{adj1}$ is derived at Step S509 or S511. The load actual result determining unit 409 repeatedly acquires the measured value $P_{res}$ of the rolling load of the steel sheet M in the control cycle of the rolling control device 10. The latest measured value $P_{res}$ of the rolling load of the steel sheet M is used in the determination at Step S521. The determination at Step S521 is equivalent to the determination as to whether or not the present time has reached a timing $t_c$. After the timing $t_b$ and before the measured value $P_{res}$ of the rolling load of the steel sheet M becomes the new preset load value $P_{set1}$ derived at Step S512, a plasticity coefficient $Q_{chk}$ at the timing $t_c$ is derived (see the top graph in FIG. 6). Thus, the constant ε is a value that exceeds 0 and falls below 1 (0<ε<1). If the period from the timing $t_b$ to the timing $t_c$ is too short, there is a possibility that the calculation accuracy will deteriorate due to the effect of various sensor errors. The various sensor errors include, for example, errors due to noise, quantization errors, measurement variations, and so on. The constant ε is set in advance so as not to cause such deterioration in calculation accuracy. For example, the constant ε is set so that the absolute value of the difference between the rolling load $P_b$ at the timing $t_b$ and a rolling load $P_c$ at the timing $t_c$ is 50 tons or more.

At Step S521, when the measured value $P_{res}$ of the rolling load of the steel sheet M is determined to be equal to or more than the sum of the pre-update preset load value $P_{set'}$ and the product of the constant ε and the correction amount $P_{adj1}$ (=$P_{set'}$+ε$P_{adj1}$), the processing at Step S522 is executed. At Step S522, a third actual result setting unit 410 sets a reduction position $S_c$, a rolling load $P_c$, and an elongation rate $e_c$ at the timing $t_c$. Incidentally, the method of setting the reduction position S, the rolling load P, and the elongation rate e is as explained at Step S504.

Then, at Step S523, a second plasticity coefficient deriving unit 411 derives the plasticity coefficient $Q_{chk}$ by (3) Equation based on the reduction position $S_b$ and the rolling load $P_b$ at the timing $t_b$ set at Step S507 and the reduction position $S_c$ and the rolling load $P_c$ at the timing $t_c$ set at Step S522. In this case, in (3) Equation, i is b and j is c. The plasticity coefficient $Q_{chk}$ corresponds to the general value of the plasticity coefficient Q during the period from the timing $t_b$ to the timing $t_c$.

In this embodiment, the timing $t_c$ is an example of a third timing. Further, the period from the timing $t_b$ to the timing $t_c$ is an example of the second period. Further, in this embodiment, the value of the reduction position $S_b$ and the value of the rolling load $P_b$ at the timing $t_b$ are examples of the operation actual result values at the second timing used when deriving a plasticity coefficient $Q_{b-c}$. Further, in this embodiment, the value of the reduction position $S_c$ and the value of the rolling load $P_c$ at the timing $t_c$ are examples of the operation actual result values at the third timing used when deriving the plasticity coefficient $Q_{b-c}$. Further, in this embodiment, the second plasticity coefficient deriving unit 411 is an example of a second plasticity coefficient deriving means.

Then, at Step S524, an evaluation index deriving unit 412 derives the ratio of the plasticity coefficient $Q_{chk}$ to the plasticity coefficient $Q_{a-b}$ (=$Q_{chk}/Q_{a-b}$).

In this embodiment, the evaluation index deriving unit 412 is an example of an evaluation index deriving means. Further, in this embodiment, the ratio of the plasticity coefficient $Q_{chk}$ to the plasticity coefficient $Q_{a-b}$(=$Q_{chk}/Q_{a-b}$) is an example of an evaluation index.

Then, at Step S525, an evaluation index determining unit 413 determines whether or not the ratio of the plasticity coefficient $Q_{chk}$ to the plasticity coefficient $Q_{a-b}$(=$Q_{chk}/Q_{a-b}$) falls below a constant ζ. Incidentally, the plasticity coefficient $Q_{a-b}$ is derived at Step S508. The plasticity coefficient $Q_{chk}$ is derived at Step S523.

In this embodiment, the evaluation index determining unit 413 is an example of a determining means. Further, as described previously, in this embodiment, the ratio of the plasticity coefficient $Q_{chk}$ to the plasticity coefficient $Q_{a-b}$ (=$Q_{chk}/Q_{a-b}$) is an example of the evaluation index.

The constant ζ is a value that exceeds 0 and falls below 1 (0<ζ<1). Thus, at Step S525, it is determined whether or not the plasticity coefficient $Q_{a-b}$ is excessively large compared to the plasticity coefficient $Q_{chk}$. That is, at Step S525, as illustrated in the bottom graph in FIG. 6, it is determined whether or not the plasticity coefficient Q has decreased significantly after the timing $t_b$. As illustrated in the bottom graph in FIG. 6, if the plasticity coefficient Q decreases significantly near the timing $t_b$, the correction amount $P_{adj1}$ derived at Step S509 based on the plasticity coefficient $Q_{a-b}$ becomes excessively large (see (5) Equation). In this case, the new preset load value $P_{set}$ derived at Step S512 needs to be updated again before the measured value P res of the rolling load of the steel sheet M becomes this new preset load value $P_{set}$. Therefore, the determination at Step S525 is equivalent to the determination as to whether or not to update the new preset load value $P_{set}$ derived at Step S512 (correction amount $P_{adj1}$ derived at Step S509) again.

The constant ζ is set in advance as follows, for example. First, the time required to converge the elongation rate e of the steel sheet M to the target value $e_{ref}$ or to the vicinity of the target value is derived. This derivation is performed for each of a plurality of the preset load values $P_{set}$. Further, this derivation is performed by numerical simulations, simulated experiments, or the like. Then, based on the results of this derivation, it is specified how much the plasticity coefficient $Q_{a-b}$ becomes excessively large compared to the plasticity coefficient $Q_{chk}$ before the time required to converge the elongation rate e of the steel sheet M to the target value $e_{ref}$ or to the vicinity of the target value exceeds the target time. The constant ζ is set based on the result of this specification.

As a result of the determination at Step S525, when the ratio of the plasticity coefficient $Q_{chk}$ to the plasticity coefficient $Q_{a-b}$(=$Q_{chk}/Q_{a-b}$) does not fall below the constant ζ, the new preset load value $P_{set}$ derived at Step S512 (correction amount Pawl derived at Step S509) does not need to be updated again. Therefore, the processing at Step S503 in FIG. 5A is executed again. In this case, the preset load value $P_{set}$ at Step S503 becomes the new preset load value $P_{set}$ derived at Step S512.

As a result of the determination at Step S525, when the ratio of the plasticity coefficient $Q_{chk}$ to the plasticity coefficient $Q_{a-b}$(=$Q_{chk}/Q_{a-b}$) falls below the constant ζ, the processing at Step S526 is executed. At Step S526, a sheet information deriving unit 414 derives the plasticity coefficient $Q_{b-c}$ based on the reduction position $S_b$ and the rolling load $P_b$ at the timing $t_b$ set at Step S507 and the reduction position S c and the rolling load $P_c$ at the timing $t_c$ set at Step S522. The plasticity coefficient $Q_{b-c}$ corresponds to the general value of the plasticity coefficient Q during the period from the timing $t_b$ to the timing $t_c$. The plasticity coefficient $Q_{b-c}$ is the same as the plasticity coefficient $Q_{chk}$ derived at Step S523. Therefore, the plasticity coefficient $Q_{b-c}$ may be the plasticity coefficient $Q_{chk}$ derived at Step S523. Further, the sheet information deriving unit 414 derives an entry-side sheet thickness $H_{1_c}$ of the steel sheet M at the timing $t_c$ based on the reduction position $S_b$, the rolling load $P_b$, and the elongation rate $e_b$ at the timing $t_b$, and the reduction position $S_c$, the rolling load $P_c$, and the elongation rate $e_c$ at the timing $t_c$ set at Step S522. Incidentally, the method of deriving the plasticity coefficient Q and the entry-side sheet thickness $H_1$ is as explained in the processing at Step S508. In this case, in (3) Equation and (4) Equation, i is b and j is c.

Then, at Step S527, a second correction amount deriving unit 415*a* (second preset load updating unit 415) derives a correction amount $P_{adj2}$ of the rolling load based on the elongation rate e, at the timing $t_c$ set at Step S522, the plasticity coefficient $Q_{b-c}$ derived at Step S526, the entry-side sheet thickness $H_{1_c}$ at the timing $t_c$ derived at Step S526, and the target value $e_{ref}$ of the elongation rate e. The method of deriving the correction amount $P_{adj}$ of the rolling load is as explained at Step S509. As illustrated in (5) Equation, the correction amount $P_{adj}$ is proportional to the plasticity coefficient Q. At Step S527, instead of the plasticity coefficient $Q_{a-b}$ derived at Step S508, the plasticity coefficient $Q_{b-c}$ derived at Step S523 is used (see the bottom graph in FIG. 6). Therefore, as illustrated in the top graph in FIG. 6, the correction amount $P_{adj2}$ derived at Step S527 is smaller than the correction amount $P_{adj1}$ derived at Step S509.

In this embodiment, the second preset load updating unit 415 including the second correction amount deriving unit 415*a* is an example of a second preset load updating means. Further, in this embodiment, the second correction amount deriving unit 415*a* is an example of a second correction amount deriving means. Further, in this embodiment, the value of the elongation rate $e_c$, the value of the entry-side sheet thickness $H_{1_c}$, and the value of the plasticity coefficient $Q_{b-c}$ are examples of the operation actual result values during the second period used when deriving the correction amount $P_{adj2}$ of the rolling load.

Then, at Step S528, the second correction amount deriving unit 415*a* determines whether or not an absolute value $|P_{adj2}|$ of P the correction amount $P_{adj2}$ derived at Step S527 is equal to or less than the constant γ. The constant γ may be, for example, the same as the constant γ used in the processing at Step S511.

As a result of the determination at Step S528, when the absolute value $|P_{adj2}|$ of the correction amount $P_{adj2}$ derived at Step S527 is equal to or less than the constant γ, the processing at Step S529 is omitted and the processing at Step S530, which is described later, is executed. On the other hand, as a result of the determination at Step S528, when the absolute value $|P_{adj2}|$ of the correction amount $P_{adj2}$ derived at Step S527 is not equal to or less than the constant γ, the processing at Step S529 is executed.

At Step S529, the second correction amount deriving unit 415*a* modifies the correction amount $P_{adj2}$ derived at Step S527 so that the absolute value $|P_{adj2}|$ of the correction amount $P_{adj2}$ derived at Step S527 becomes the constant γ. At this time, the first correction amount deriving unit 415*a* sets the sign of the modified correction amount $P_{adj2}$ to be the same as the sign of the correction amount $P_{adj2}$, which is before the modification.

Then, at Step S530, a second updated value deriving unit 415*b* (the second preset load updating unit 415) derives the value obtained by adding the correction amount $P_{adj2}$ derived at Step S527 or S529 to the pre-update preset load value $P_{set'}$ as a new preset load value $P_{set}$. Then, the second updated value deriving unit 415*b* outputs a reduction command including the new preset load value $P_{set}$ to the reduction position control device 2. Thereby, in FIG. 6, the reduction position control device 2 changes the reduction position of the temper rolling mill 1 so that the rolling load of the steel sheet M approaches the new preset load value $P_{set}$ (in the example illustrated in FIG. 6, the new preset load value $P_{set}$ is $P_{set2}$). When these pieces of the processing are performed consecutively in the order of Steps S502, S503, S504, S505, S506, S507, S508, S509, S510, S512, S521, S522, S523, S524, S525, S526, S527, S528, and S530, the new preset load value $P_{set}$ becomes the sum of the initial preset load value $P_{init}$ and the correction amount $P_{adj2}$ derived at Step S527 ($P_{set}=P_{init}+P_{adj2}$). As de scribed previously, in the example illustrated in FIG. 6, the new preset load value $P_{set}$ derived as above is $P_{set2}$. Then, the processing at Step S503 in FIG. 5A is executed again. In this case, the preset load value $P_{set}$ at Step S503 becomes the new preset load value $P_{set}$ derived at Step S530.

In this embodiment, the new preset load value $P_{set}$ ($P_{set2}$) is an example of a re-updated value of the preset load. Further, in this embodiment, the second preset load updating unit 415 including the second updated value deriving unit 415*b* is an example of the second preset load updating means. Further, in this embodiment, the second updated value deriving unit 415*b* is an example of a second updated value deriving means.

SUMMARY

As above, in this embodiment, the rolling control device 10 derives the correction amount $P_{adj1}$ for the preset load value $P_{set}$ based on the operation actual result values during the period from the timing $t_a$, which is before the timing $t_b$ when the rolling load of the steel sheet M has become the preset load value $P_{set'}$ to the timing $t_b$. Then, the rolling control device 10 updates the preset load value $P_{set}$ using the correction amount $P_{adj1}$. Thereafter, the rolling control device 10 derives the plasticity coefficient $Q_{chk}$ based on the operation actual result values during the period from the timing $t_b$ to the timing $t_c$ before the measured value $P_{res}$ of the rolling load of the steel sheet M becomes the updated preset load value $P_{set}$. Then, the rolling control device 10 determines whether or not it is necessary to re-update the updated preset load value $P_{set}$ based on the plasticity coefficient $Q_{chk}$. As a result of this determination, when the updated preset load value $P_{set}$ needs to be updated again, the rolling control device 10 derives the correction amount $P_{adj2}$ for the preset load value $P_{set'}$ which is before update, based on the operation actual result values during the period from the timing $t_b$ to the timing $t_c$. Then, the rolling control device 10 updates the preset load value $P_{set}$ again using the correction amount $P_{adj2}$. Thus, before the measured value $P_{res}$ of the rolling load of the steel sheet M becomes the preset load value $P_{set}$ updated based on the excessively large plasticity coefficient Q, the preset load value $P_{set}$ can be updated again based on the plasticity coefficient $Q_{b-c}$, which is close to the actual plasticity coefficient Q at this time. Therefore, the time required to converge the elongation rate e of the steel sheet M to the target value $e_{ref}$ or to the vicinity of the target value $e_{ref}$ is shortened.

Second Embodiment

Next, there is explained a second embodiment. In the first embodiment, there has been explained, as an example, the case where the rolling control device 10 determines whether or not it is necessary to re-update the updated preset load value $P_{set}$ based on the plasticity coefficient $Q_{chk}$. However, the determination as to whether or not the plasticity coefficient Q of the steel sheet M has varied significantly may be made based on a physical quantity that is correlated with the plasticity coefficient Q instead of the plasticity coefficient Q itself. Thus, in this embodiment, there is explained the case where the entry-side sheet thickness $H_1$ of the steel sheet M is used as such a physical quantity. Thus, this embodiment differs from the first embodiment mainly in the method of determining whether or not the updated preset load value $P_{set}$ needs to be updated again. Therefore, in the explanation in this embodiment, the same parts as those in the first embodiment are denoted by the same reference numerals and symbols as those in FIG. 1 to FIG. 6, and their detailed explanation is omitted.

<Rolling Control Device 10>

Figure 7:
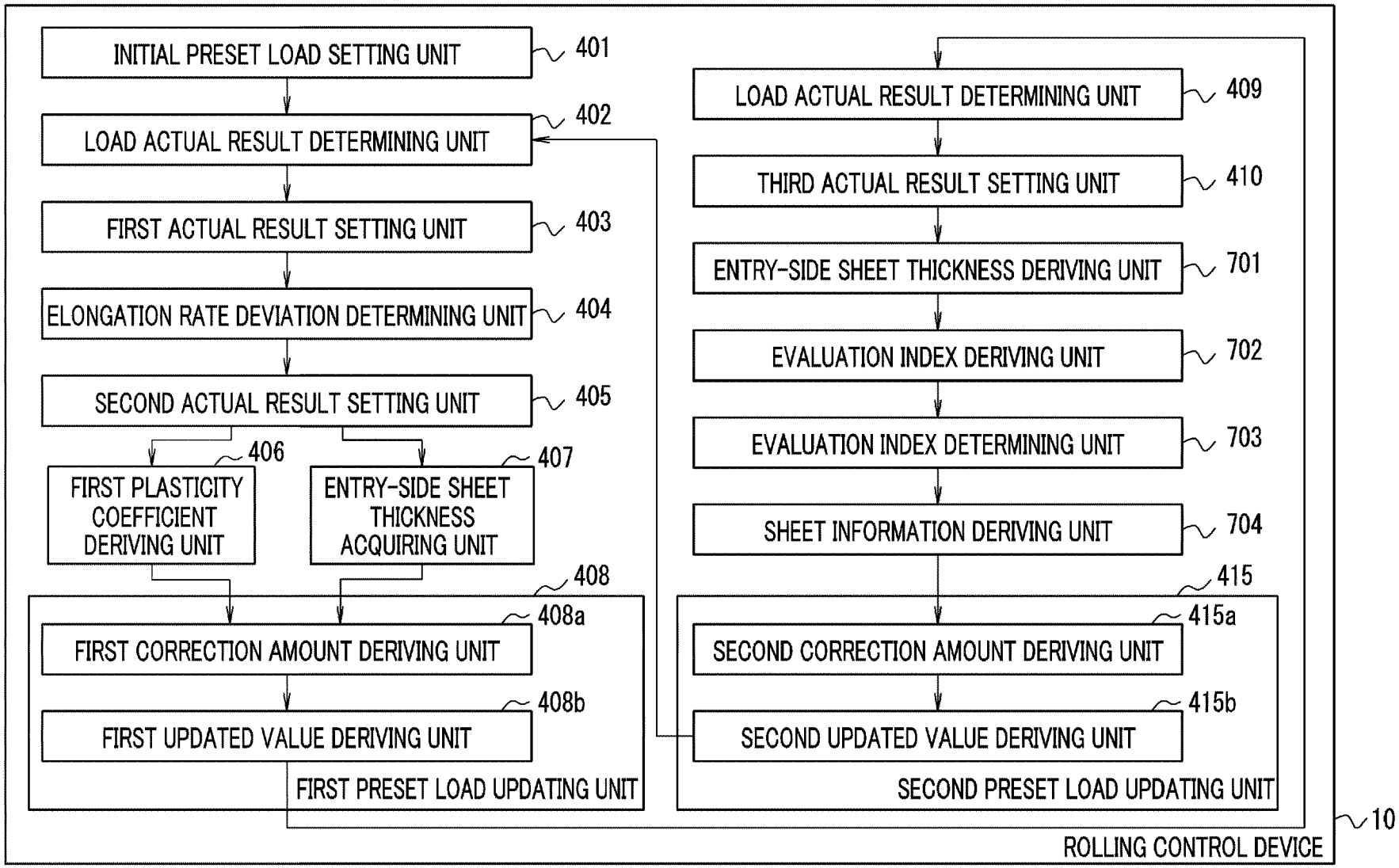
FIG. 7 is a diagram illustrating a second example of the functional configuration of the rolling control device.
Figure 8:
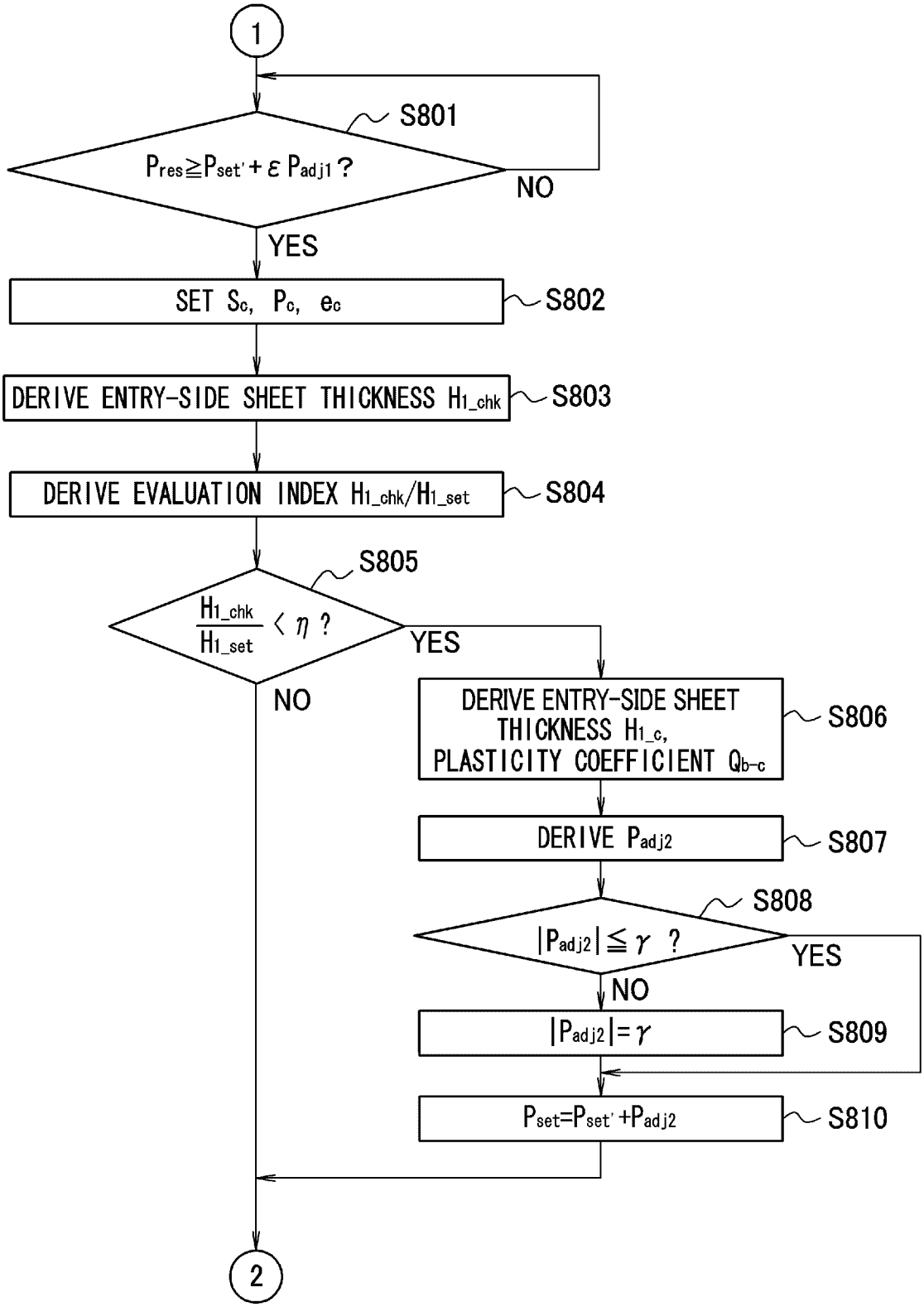
FIG. 8 is a view illustrating a second example of the flowchart following FIG. 5A.

FIG. 7 is a diagram illustrating an example of the functional configuration of a rolling control device 10. FIG. 8 is a flowchart illustrating an example of the processing of the rolling control device 10. FIG. 8 is replaced with FIG. 5B explained in the first embodiment. After the flowchart in FIG. 5A (the processing at Step S512) is executed, the processing according to the flowchart in FIG. 8 is executed (the rolling control device 10 in this embodiment also executes the processing according to the flowchart in FIG. 5A).

With reference to FIG. 8, there is explained an example of the processing of each functional block of the rolling control device 10 illustrated in FIG. 7. However, an initial preset load setting unit 401, a load actual result determining unit 402, a first actual result setting unit 403, an elongation rate deviation determining unit 404, a second actual result setting unit 405, a first plasticity coefficient deriving unit 406, an entry-side sheet thickness acquiring unit 407, and a first preset load updating unit 408 (a first correction amount deriving unit 408*a* and a first updated value deriving unit 408*b*) are the same as those explained in the first embodiment. Thus, the detailed explanations of these functional blocks are omitted.

After the processing at Step S512 in FIG. 5A is finished, the processing at Step S801 in FIG. 8 is executed. At Step S801, a load actual result determining unit 409 determines whether or not the measured value $P_{res}$ of the rolling load of the steel sheet M is equal to or more than the sum of the pre-update preset load value $P_{set'}$ and the product of the constant E and the correction amount $P_{adj1}(=P_{set'}+\varepsilon P_{adj1})$. When the measured value $P_{res}$ of the rolling load of the steel sheet M is not equal to or more than the sum of the pre-update preset load value $P_{set'}$ and the product of the constant E and the correction amount $P_{adj1}(=P_{set'}+\varepsilon P_{adj1})$ the processing at Step S801 is executed again. The processing at Step S801 is the same as the processing at Step S521 in FIG. 5B.

At Step S801, when the measured value $P_{res}$ of the rolling load of the steel sheet M is determined to be equal to or more than the sum of the pre-update preset load value $P_{set'}$ and the product of the constant ε and the correction amount $P_{adj1}$ $(=P_{set'}+\varepsilon P_{adj1})$, the processing at Step S802 is executed. At Step S802, a third actual result setting unit 410 sets the reduction position $S_c$, the rolling load $P_c$, and the elongation rate $e_c$ at the timing $t_c$. The processing at Step S802 is the same as the processing at Step S522 in FIG. 5B.

Then, at Step S803, an entry-side sheet thickness deriving unit 701 derives an entry-side sheet thickness $H_{1_chk}$ of the steel sheet M based on the rolling load $P_b$ and the elongation rate $e_b$ at the timing $t_b$ set at Step S507 in FIG. 5A, the rolling load $P_c$ and the elongation rate $e_c$ at the timing $t_c$ set at Step S802, and the plasticity coefficient $Q_{a-b}$ derived at Step S508 in FIG. 5A.

In pieces of the processing (S508, S526, and S806) other than the processing at Step S803, an entry-side sheet thickness $H_{1_j}$ at a timing $t_j$ is derived by substituting a general plasticity coefficient $Q_{i-j}$ during the period from a timing $t_i$ to the timing $t_j$ into (4) Equation. The general plasticity coefficient $Q_{i-j}$ during the period from the timing $t_i$ to the timing $t_j$ is derived based on rolling loads $P_i$, $P_j$ and reduction positions $S_i$, $S_j$ at the timings $t_i$, $t_j$. On the other hand, at Step S803, the entry-side sheet thickness deriving unit 701 derives the entry-side sheet thickness $H_{1_chk}$ by substituting the plasticity coefficient $Q_{a-b}$ derived at Step S508 in FIG. 5A, the rolling load $P_b$ and the elongation rate $e_b$ at the timing $t_b$, and the rolling load $P_c$ and the elongation rate $e_c$ at the timing $t_c$ set at Step S802, into (4) Equation. This is to evaluate whether or not the plasticity coefficient $Q_{a-b}$ is excessively large at Step S805 below as at Step S525.

In this embodiment, the timing $t_c$ is an example of the third timing. Further, in this embodiment, the values of the rolling loads $P_b$ and $P_c$ and the values of the elongation rates $e_b$ and $e_c$ are examples of the operation actual result values during the second period used when deriving the entry-side sheet thickness $H_{1_chk}$ of the steel sheet M. Further, in this embodiment, the entry-side sheet thickness deriving unit 701 is an example of an entry-side sheet thickness deriving means.

Then, at Step S804, an evaluation index deriving unit 702 derives the ratio of the entry-side sheet thickness $H_{1_chk}$ to an entry-side sheet thickness set value $H_{1_set}(=H_{1_chk}/H_{1_set})$.

In this embodiment, the evaluation index deriving unit 702 is an example of the evaluation index deriving means. Further, in this embodiment, the ratio of the entry-side sheet thickness $H_{1_chk}$ to the entry-side sheet thickness set value $H_{1_set}(=H_{1_chk}/H_{1_set})$ is an example of the evaluation index.

Then, at Step S805, an evaluation index determining unit 703 determines whether or not the ratio of the entry-side sheet thickness $H_{1_chk}$ to the entry-side sheet thickness set value $H_{1_set}$ $(=H_{1_chk}/H_{1_set})$ falls below a constant r. Incidentally, the entry-side sheet thickness set value $H_{1_set}$ is determined in advance based on the specifications of the steel sheet M. The entry-side sheet thickness $H_{1_chk}$ is derived at Step S803.

In this embodiment, the evaluation index determining unit 703 is an example of the determining means. Further, as described previously, in this embodiment, the ratio of the entry-side sheet thickness chk to the entry-side sheet thickness set value $H_{1_set}$ $H_{1_chk}/H_{1_set}$) is an example of the evaluation index.

The constant η is a value that exceeds 0 and falls below 1 (0<η<1). Therefore, at Step S805, it is determined whether or not the plasticity coefficient $Q_{a-b}$ is excessively large compared to the plasticity coefficient Q during the period from the timing $t_b$ to the timing $t_c$. As illustrated in (4) Equation, the entry-side sheet thickness $H_1$ and the plasticity coefficient Q are inversely proportional to each other. Further, the actual entry-side sheet thickness $H_1$ does not significantly differ from the entry-side sheet thickness set value $H_{1_set}$. Thus, if the entry-side sheet thickness set value $H_{1_set}$ is excessively larger than the entry-side sheet thickness $H_{1_chk}$ derived based on the plasticity coefficient $Q_{a-b}$, the plasticity coefficient Q is considered to have decreased significantly near the timing $t_b$. Thus, in this embodiment, the evaluation index determining unit 703 determines whether or not the ratio of the entry-side sheet thickness $H_{1_chk}$ to the entry-side sheet thickness set value $H_{1_set}$ falls below the constant n.

The constant η is set in advance as follows, for example. First, the time required to converge the elongation rate e of the steel sheet M to the target value $e_{ref}$ or to the vicinity of the target value is derived. This derivation is performed for each of a plurality of the preset load values $P_{set}$ Further, this derivation is performed by numerical simulations, simulated experiments, or the like. Then, based on the results of this derivation, it is specified how much the entry-side sheet thickness $H_1$ becomes excessively large before the time required to converge the elongation rate e of the steel sheet M to the target value $e_{ref}$ or to the vicinity of the target value exceeds the target time. The constant η is set based on the result of this specification.

As a result of the determination at Step S805, when the ratio of the entry-side sheet thickness $H_{1_chk}$ to the entry-side sheet thickness set value $H_{1_set}$ (=$H_{1_chk}/H_{1_set}$) does not fall below the constant η, the new preset load value $P_{set}$ derived at Step S512 (correction amount $P_{adj1}$ derived at Step S509) does not need to be updated again. Therefore, the processing at Step S503 in FIG. 5A is executed again. In this case, the preset load value $P_{set}$ at Step S503 becomes the new preset load value $P_{set}$ derived at Step S512.

On the other hand, as a result of the determination at Step S805, when the ratio of the entry-side sheet thickness $H_{1_chk}$ to the entry-side sheet thickness set value $H_{1_set}$(=$H_{1_chk}/H_{1_set}$) falls below the constant n, the processing at Step S806 is executed. At Step S806, a sheet information deriving unit 704 derives the plasticity coefficient $Q_{b-c}$ based on the reduction position $S_b$ and the rolling load $P_b$ at the timing $t_b$ set at Step S507 and the reduction position $S_c$ and the rolling load $P_c$ at the timing $t_c$ set at Step S802. Further, the sheet information deriving unit 704 derives the entry-side sheet thickness $H_{1_c}$ of the steel sheet M at the timing $t_c$ based on the reduction position $S_b$, the rolling load $P_b$, and the elongation rate $e_b$ at the timing $t_b$ and the reduction position $S_c$, the rolling load $P_c$, and the elongation rate $e_c$ at the timing $t_c$ set at Step S802. Incidentally, the method of deriving the plasticity coefficient Q and the entry-side sheet thickness $H_1$ is as explained in the processing at Step S508. In (3) Equation and (4) Equation at this time, i is b and j is c.

In this embodiment, the sheet information deriving unit 704 is an example of a sheet information deriving means. Further, in this embodiment, the values of the reduction positions $S_b$ and $S_c$, the values of the rolling loads $P_b$ and $P_c$, and the values of the elongation rates $e_b$ and $e_c$ are examples of the operation actual result values during the second period used when deriving the entry-side sheet thickness $H_{1_c}$ of the steel sheet M.

Incidentally, at Step S806, the general plasticity coefficient $Q_{b-c}$ during the period from the timing $t_b$ to the timing $t_c$ is derived based on the rolling loads $P_b$ and $P_c$ and the reduction positions $S_b$ and $S_c$ at the timings $t_b$ and $t_c$. The entry-side sheet thickness $H_1$, of the steel sheet M at the timing $t_c$ is derived based on the plasticity coefficient $Q_{b-c}$ and (4) Equation. Thus, the entry-side sheet thickness $H_{1_}$, derived at Step S806 is different from the entry-side sheet thickness $H_{1_chk}$ derived at Step S803.

Pieces of subsequent processing at Steps S807 to S810 are the same as those at Steps S528 to S530 in FIG. 5B. That is, at Step S807, a second correction amount deriving unit 415*a* derives the correction amount $P_{adj2}$ of the rolling load based on the elongation rate $e_c$ at the timing $t_c$ set at Step S802, the plasticity coefficient $Q_{b-c}$ derived at Step S806, the entry-side sheet thickness $H_{1_c}$ at the timing $t_c$ derived at Step S806, and the target value $e_{ref}$ of the elongation rate e.

In this embodiment, a second preset load updating unit 415 including the second correction amount deriving unit 415*a* is an example of the second preset load updating means. Further, in this embodiment, the second correction amount deriving unit 415*a* is an example of the second correction amount deriving means.

Then, at Step S808, the second correction amount deriving unit 415*a* determines whether or not the absolute value $|P_{adj2}|$ of the correction amount $P_{adj2}$ derived at Step S807 is equal to or less than the constant γ.

As a result of the determination at Step S808, when the absolute value $|P_{adj2}|$ of the correction amount $P_{adj2}$ derived at Step S807 is equal to or less than the constant γ, the processing at Step S809 is omitted and the processing at Step S810 is executed. On the other hand, as a result of the determination at Step S808, when the absolute value $|P_{adj2}|$ of the correction amount $P_{adj2}$ derived at Step S807 is not equal to or less than the constant γ, the processing at Step S809 is executed.

At Step S809, the second correction amount deriving unit 415*a* modifies the correction amount $P_{adj2}$ derived at Step S807 so that the absolute value of the correction amount $P_{adj2}$ derived at Step S807 becomes the constant γ.

Then, at Step S810, a second updated value deriving unit 415*b* derives the value obtained by adding the correction amount $P_{adj2}$ derived at Step S807 or S809 to the pre-update preset load value $P_{set'}$ as a new preset load value $P_{set}$. Then, the processing at Step S503 in FIG. 5A is executed again. In this case, the preset load value $P_{set}$ at Step S503 becomes the new preset load value $P_{set}$ derived at Step S810.

In this embodiment, the new preset load value $P_{set}$ ($P_{set2}$) is an example of the re-updated value of the preset load. Further, in this embodiment, the second preset load updating unit 415 including the second updated value deriving unit 415*b* is an example of the second preset load updating means. Further, in this embodiment, the second updated value deriving unit 415*b* is an example of the second updated value deriving means.

SUMMARY

As above, in this embodiment, the rolling control device 10 derives the entry-side sheet thickness $H_{1_chk}$ of the steel sheet M based on the operation actual result values during the period from the timing $t_b$ to the timing $t_c$ before the measured value $P_{res}$ of the rolling load of the steel sheet M becomes the updated preset load value $P_{set}$. However, the plasticity coefficient Q is the plasticity coefficient $Q_{a-b}$ derived based on the operation actual result values during the period from the timing $t_a$, which is before the timing $t_b$ when the rolling load of the steel sheet M has become the preset load value $P_{set}$, to the timing $t_b$. Thereafter, the rolling control device 10 determines whether or not it is necessary to re-update the updated preset load value $P_{set}$ based on the entry-side sheet thickness $H_{1_chk}$ of the steel sheet M. In this embodiment, as an index for determining whether or not it is necessary to re-update the preset load value $P_{set}$, the entry-side sheet thickness $H_1$ is used, which makes it easy for an on-site operator to intuitively grasp the difference. Thus, for example, by the rolling control device 10 outputting (for example, displaying) information on the entry-side sheet thickness $H_{1_chk}$ of the steel sheet M, the on-site operator can utilize the information as information that serves as a work guideline.

MODIFIED EXAMPLES

In this embodiment, there has been explained, as an example, the case where the entry-side sheet thickness $H_{1_chk}$ of the steel sheet M is compared with the entry-side sheet thickness set value $H_1$_set. However, this embodiment does not need to be designed in this manner. For example, the entry-side sheet thickness $H_1$ of the steel sheet M derived at Step S806 may be used instead of the entry-side sheet thickness set value $H_{1_set}$. In this case, the processing at Step S806 is executed before Step S804.

Further, the physical quantity that is correlated with the plasticity coefficient Q is not limited to the entry-side sheet thickness $H_1$ of the steel sheet M. For example, (3) Equation reveals that the difference between the rolling loads at the two timings and the difference between the reduction positions at the two timings are correlated with the plasticity coefficient Q. Thus, the physical quantity that is correlated with the plasticity coefficient Q may be the rolling load or the reduction position.

Incidentally, in this embodiment, in pieces of the processing other than the processing at Step S803, the value of the entry-side sheet thickness $H_1$ of the steel sheet M may be a value measured by a sheet thickness meter.

Example

Figure 9:
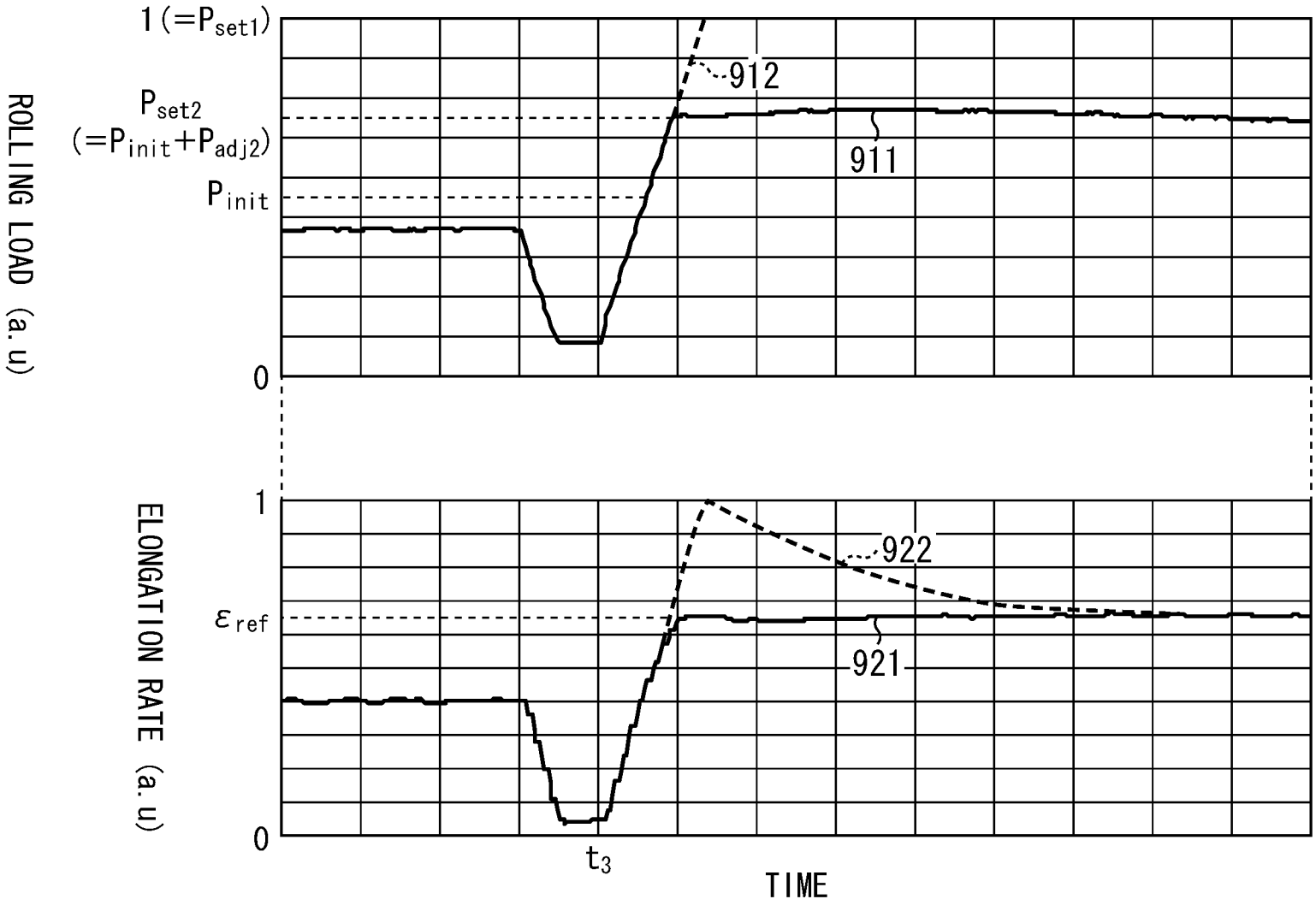
FIG. 9 is a view illustrating results of numerical simulations of a rolling load and an elongation rate.

Next, there are explained examples. In this example, the rolling load and the elongation rate when the steel sheet M was temper-rolled were derived by numerical simulations. FIG. 9 is a view illustrating examples of the results. Incidentally, in FIG. 9, the units for the value of the rolling load and the value of the elongation rate are arbitrary units.

In FIG. 9, a graph 911 illustrates the relationship between the rolling load when the steel sheet M was temper-rolled by the method in the second embodiment and a time. A graph 912 illustrates the relationship between the rolling load when the steel sheet M was temper-rolled by the method described in Patent Literature 1 and a time. A graph 921 illustrates the relationship between the elongation rate when the steel sheet M was temper-rolled by the method in the second embodiment and a time. A graph 922 illustrates the relationship between the elongation rate when the steel sheet M was temper-rolled by the method described in Patent Literature 1 and a time.

As illustrated in FIG. 9, it can be found out that the method in the second embodiment can shorten the time required to converge the elongation rate e of the steel sheet M to the target value $e_{ref}$ compared to the method described in Patent Literature 1.

(Hardware of the Rolling Control Device 10)

Figure 10:
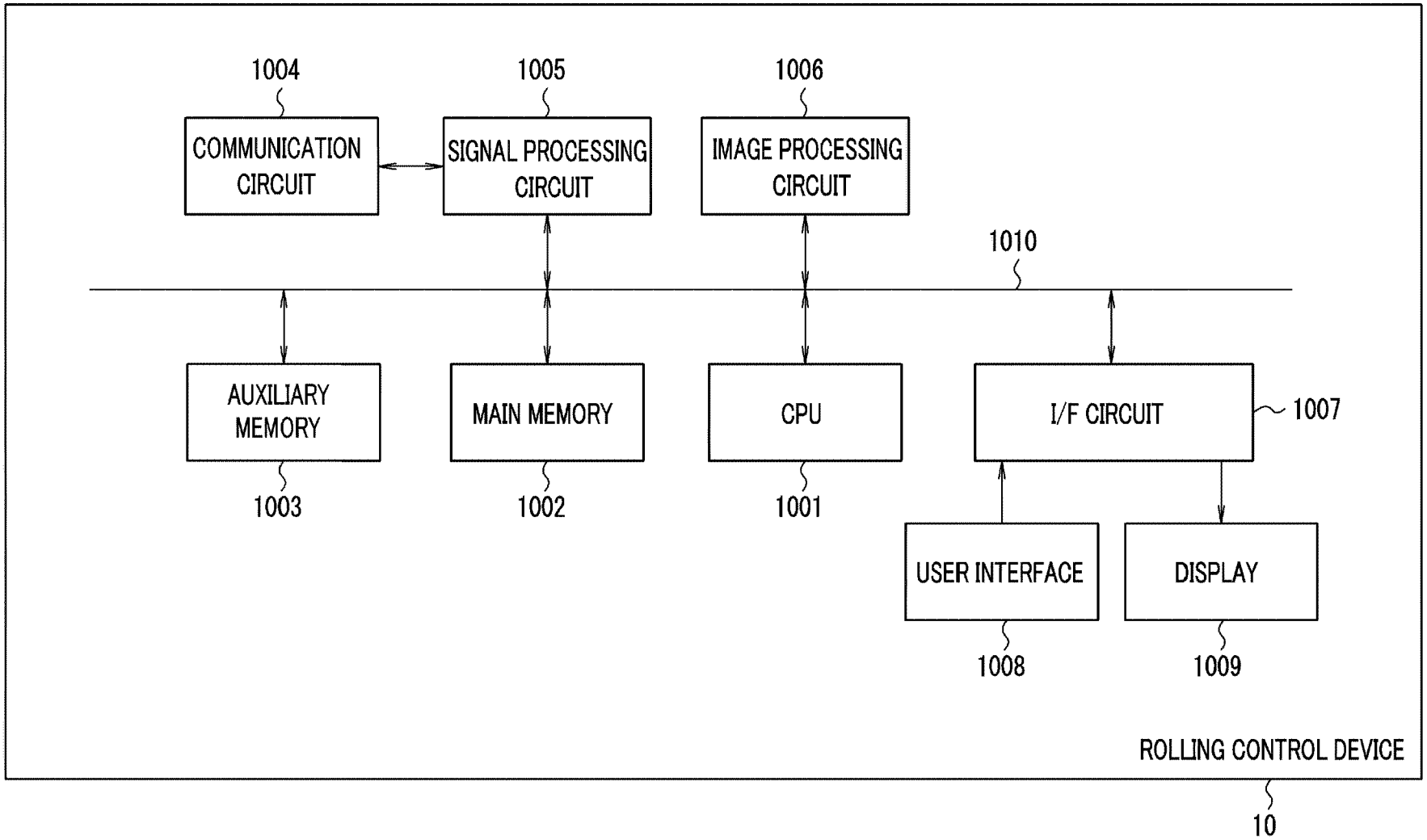
FIG. 10 is a diagram illustrating an example of a hardware of the rolling control device.

There is explained an example of the hardware of the rolling control device 10. In FIG. 10, the rolling control device 10 includes a CPU 1001, a main memory 1002, an auxiliary memory 1003, a communication circuit 1004, a signal processing circuit 1005, an image processing circuit 1006, an I/F circuit 1007, a user interface 1008, a display 1009, and a bus 1010.

The CPU 1001 overall controls the entire rolling control device 10. The CPU 1001 uses the main memory 1002 as a work area to execute a program stored in the auxiliary memory 1003. The main memory 1002 stores data temporarily. The auxiliary memory 1003 stores various data, in addition to programs to be executed by the CPU 1001.

The communication circuit 1004 is a circuit intended for performing communication with the outside of the rolling control device 10. The communication circuit 1004 may perform radio communication or wire communication with the outside of the rolling control device 10.

The signal processing circuit 1005 performs various pieces of signal processing on signals received in the communication circuit 1004 and signals input according to the control by the CPU 1001.

The image processing circuit 1006 performs various pieces of image processing on signals input according to the control by the CPU 1001. The signal that has been subjected to the image processing is output on the display 1009, for example.

The user interface 1008 is a part in which the operator gives an instruction to the rolling control device 10. The user interface 1008 includes buttons, switches, dials, and so on, for example. Further, the user interface 1008 may include a graphical user interface using the display 1009.

The display 1009 displays an image based on a signal output from the image processing circuit 1006. The I/F circuit 1007 exchanges data with a device connected to the I/F circuit 1007. In FIG. 10, as the device to be connected to the I/F circuit 1007, the user interface 1008 and the display 1009 are illustrated. However, the device to be connected to the I/F circuit 1007 is not limited to these. For example, a portable storage medium may be connected to the I/F circuit 1007. Further, at least a part of the user interface 1008 and the display 1009 may be provided outside the rolling control device 10.

Incidentally, the CPU 1001, the main memory 1002, the auxiliary memory 1003, the signal processing circuit 1005, the image processing circuit 1006, and the I/F circuit 1007 are connected to the bus 1010. Communication among these components is performed via the bus 1010. Further, the hardware of the rolling control device 10 is not limited to the one illustrated in FIG. 10 as long as it can perform the previously-described functions of the rolling control device 10. For example, the hardware of the rolling control device may be well-known hardware used for implementing AEC.

OTHER EMBODIMENTS

Incidentally, the embodiments of the present invention explained above can be fabricated by causing a computer to execute a program. Further, a computer-readable recording medium in which the aforementioned program is recorded and a computer program product such as the aforementioned program can also be applied as the embodiment of the present invention. As the recording medium, it is possible to use a flexible disk, a hard disk, an optical disk, a magneto-optic disk, a CD-ROM, a magnetic tape, a nonvolatile memory card, a ROM, or the like, for example.

Further, the embodiments of the present invention explained above merely illustrate concrete examples of implementing the present invention, and the technical scope of the present invention is not to be construed in a restrictive manner by the embodiment. That is, the present invention may be implemented in various forms without departing from the technical spirit or main features thereof.

(In Relation to Claims)

The following is an example of the relationship between the claims and the embodiments. Note that the description of the claims is not limited to the description of the embodiments, as mentioned above.

<Claim 1>

The first timing is achieved by the timing $t_a$, for example.

The second timing is achieved by the timing $t_b$, for example.

The first preset load updating means is achieved by using the first preset load updating unit 408 (the first correction amount deriving unit 408*a* and the first updated value deriving unit 408*b*), for example.

The updated value of the preset load is achieved by the new preset load value $P_{set}$ ($P_{set1}$), for example.

The third timing is achieved by the timing $t_c$, for example.

The evaluation index deriving means is achieved by using the evaluation index deriving unit 412 or the evaluation index deriving unit 702, for example.

The evaluation index is achieved by using the ratio of the plasticity coefficient $Q_{chk}$ to the plasticity coefficient $Q_{a-b}$ ($=Q_{chk}/Q_{a-b}$) or the ratio of the entry-side sheet thickness $H_{1_chk}$ to the entry-side sheet thickness set value $H_{1_set}$ ($=H_{1_chk}/H_{1_set}$), for example.

The determining means is achieved by using the evaluation index determining unit 413 or the evaluation index determining unit 703, for example.

The second preset load updating means is achieved by using the second preset load updating unit 415 (the second correction amount deriving unit 415*a* and the second updated value deriving unit 415*b*), for example.

The re-updated value of the preset load is achieved by the new preset load value $P_{set}$ ($P_{set2}$) for example.

<Claim 2>

The first correction amount deriving means is achieved by using the first correction amount deriving unit 408*a*, for example.

The first correction amount is achieved by the correction amount $P_{adj1}$, for example.

The first updated value deriving means is achieved by using the first updated value deriving unit 408*b*, for example.

The second correction amount deriving means is achieved by using the second correction amount deriving unit 415*a*, for example.

The second correction amount is achieved by the correction amount $P_{adj2}$, for example.

The second updated value deriving means is achieved by using the second updated value deriving unit 415*b*, for example.

<Claim 3>

The first plasticity coefficient deriving means is achieved by using the first plasticity coefficient deriving unit 406, for example.

The second plasticity coefficient deriving means is achieved by using the second plasticity coefficient deriving unit 411, for example.

The plasticity coefficient of the metal sheet derived by the first plasticity coefficient deriving means is achieved by using the plasticity coefficient $Q_{a-b}$, for example.

The plasticity coefficient of the metal sheet derived by the second plasticity coefficient deriving means is achieved by using the plasticity coefficient $Q_{chk}$, for example.

<Claims 4, 5>

The physical quantity that is correlated with the plasticity coefficient of the metal sheet is achieved by using the entry-side sheet thickness $H_1$ of the steel sheet, the rolling load P, or the reduction position S, for example.

<Claim 6>

The first plasticity coefficient deriving means is achieved by using the first plasticity coefficient deriving unit 406, for example.

The entry-side sheet thickness deriving means is achieved by using the entry-side sheet thickness deriving unit 701, for example.

The plasticity coefficient of the metal sheet derived by the first plasticity coefficient deriving means is achieved by using the plasticity coefficient $Q_{a-b}$ for example.

The entry-side sheet thickness of the metal sheet derived by the entry-side sheet thickness deriving means is achieved by the entry-side sheet thickness $H_{1_chk}$ of the steel sheet M, for example.

The entry-side sheet thickness set value of the metal sheet based on the specifications of the metal sheet is achieved by the entry-side sheet thickness set value $H_{1_set}$ of the steel sheet M, for example.

The entry-side sheet thickness of the metal sheet at the third timing is achieved by the entry-side sheet thickness $H_{1_c}$ of the steel sheet M at the timing $t_c$, for example.

<Claim 7>

The sheet information deriving means is achieved by using the sheet information deriving unit 414, for example.

INDUSTRIAL APPLICABILITY

The present invention can be utilized for temper rolling of a metal sheet, for example.

The invention claimed is:

1. A rolling control device that derives a preset load value in order to bring an elongation rate of a metal sheet to a target value or within a target range after a welded portion of the metal sheet passes through a temper rolling mill while rolling is suspended or under soft reduction, and outputs a reduction command based on the preset load value, the device comprising:

a computer processor including processing circuitry that:

derives an updated value of the preset load based on operation actual result values during a first period from a first timing to a second timing;

derives an evaluation index of the difference between a plasticity coefficient of the metal sheet during the first period and a plasticity coefficient of the metal sheet during a second period from the second timing to a third timing;

determines whether or not the updated value of the preset load derived needs to be updated again based on the evaluation index derived;

derives a re-updated value of the preset load based on operation actual result values during the second period when the updated value of the preset load derived needs to be updated again;

derives a first plasticity coefficient of the sheet based on ration actual result values at the first timing and operation actual result values at the second timing; and derives a second plasticity coefficient of the met sheet or a physical quantity that is correlated with a plasticity coefficient of the metal sheet operation actual result values at the second timing and operation actual result values at the third timing, wherein the preset load is a rolling load to be preset as a target rolling load of the temper rolling mill, the first timing is a timing before a timing when a measured value of a rolling load at the temper rolling mill becomes the preset load, the second timing is a timing when the measured value of the rolling load at the temper rolling mill has become the preset load, the third timing is a timing before the measured value of the rolling load at the temper rolling mill becomes the updated value of the preset load derived, and the evaluation index is an index determined based on the first plasticity coefficient and the second plasticity coefficient or the physical quantity.

2. The rolling control device according to claim 1, wherein the compute processor:

derives a first correction amount for the preset load, which is before update based on the operation actual result values during the first period;

derives an updated value of the preset load based on the preset load, which is before update, and the first correction amount derived;

derives a second correction amount for the preset load, which is before update based on the operation actual result values during the second period; and derives a re-updated value of the preset load based on the preset load, which is before update, and the second correction amount derived.

3. The rolling control device according to claim 1, wherein the computer processor derives the first plasticity coefficient and the second plasticity coefficient based on operation actual result values at the first timing and operation actual result values at the second timing, and the evaluation index is an index determined based on the first plasticity coefficient and the second plasticity coefficient.

4. The rolling control device according to claim 1, wherein the evaluation index is an index determined based on the plasticity coefficient and the physical quantity.

5. The rolling control device according to claim 4, wherein the physical quantity that is correlated with the plasticity coefficient of the metal sheet includes an entry-side sheet thickness of the metal sheet.

6. The rolling control device according to claim 5, wherein the computer processor:

derives the first plasticity coefficient;

derives the entry-side sheet thickness of the metal sheet based on the first plasticity coefficient and the operation actual result values during the second period; and derives the evaluation index based on the entry-side sheet thickness of the metal sheet and a set value of the entry-side sheet thickness of the metal sheet based on specifications of the metal sheet or the entry-side sheet thickness of the metal sheet at the third timing.

7. The rolling control device according to claim 6, wherein the computer processor derives the entry-side sheet thickness of the metal sheet at the third timing based on the second plasticity coefficient and the operation actual result values during the second period.

8. A rolling control method that derives a preset load value in order to bring an elongation rate of a metal sheet to a target value or within a target range after a welded portion of the metal sheet passes through a temper rolling mill while rolling is suspended or under soft reduction, and outputs a reduction command based on the preset load value with a computer, wherein, the computer executes:

a first preset load updating step that derives an updated value of the preset load based on operation actual result values during a first period from a first timing to a second timing;

an evaluation index deriving step that derives an evaluation index of the difference between a plasticity coefficient of the metal sheet during the first period and a plasticity coefficient of the metal sheet during a second period from the second timing to a third timing;

a determining step that determines whether or not the updated value of the preset load derived by the first preset load updating step needs to be updated again based on the evaluation index derived by the evaluation index deriving step;

a second preset load updating step that derives a re-updated value of the preset load based on operation actual result values during the second period when the determining step determines that the updated value of the preset load derived by the first preset load updating step needs to be updated again;

a first plasticity deriving step that derives first plasticity coefficient of the metal sheet based on operation actual result values at the first timing and operation actual result values at the second timing; and a second deriving step that derives a second plasticity coefficient of the metal sheet or a physical quantity that is correlated with a plasticity coefficient of the metal sheet based on the operation actual result values at the second timing and operation actual result values at the third timing, wherein the preset load is a rolling load to be preset as a target rolling load of the temper rolling mill, the first timing is a timing before a timing when a measured value of a rolling load at the temper rolling mill becomes the preset load, the second timing is a timing when the measured value of the rolling load at the temper rolling mill has become the preset load, the third timing is a timing before the measured value of the rolling load at the temper rolling mill becomes the updated value of the preset load derived by the first preset load updating step, and the evaluation index is an index determined based on the first plasticity coefficient and the second plasticity coefficient or the physical quanitiy.

9. A non-transitory computer readable medium storing a program causing a computer to execute pieces of processing intended for deriving a preset load value in order to bring an elongation rate of a metal sheet to a target value or within a target range after a welded portion of the metal sheet passes through a temper rolling mill while rolling is suspended or under soft reduction, and outputting a reduction command based on the preset load value, the program causing a computer to execute:

a first preset load updating step that derives an updated value of the preset load based on operation actual result values during a first period from a first timing to a second timing;

an evaluation index deriving step that derives an evaluation index of the difference between a plasticity coefficient of the metal sheet during the first period and a plasticity coefficient of the metal sheet during a second period from the second timing to a third timing;

a determining step that determines whether or not the updated value of the preset load derived by the first preset load updating step needs to be updated again based on the evaluation index derived by the evaluation index deriving step;

a second preset load updating step that derives a re-updated value of the preset load based on operation actual result values during the second period when the determining step determines that the updated value of the preset load derived by the first preset load updating step needs to be updated again;

a first plasticity deriving step that derives a first plasticity coefficient of the metal sheet based on operation actual result values at the first timing and operation actual result values at the second timing: and a second deriving step that derives a second plasticity coefficient of the metal sheet or a physical quantity that is correlated with a plasticity coefficient of the metal sheet based on the operation actual result values at the second timing and operation actual result values at the third timing, wherein the preset load is a rolling load to be preset as a target rolling load of the temper rolling mill, the first timing is a timing before a timing when a measured value of a rolling load at the temper rolling mill becomes the preset load, the second timing is a timing when the measured value of the rolling load at the temper rolling mill has become the preset load, the third timing is a timing before the measured value of the rolling load at the temper rolling mill becomes the updated value of the preset load derived by the first preset load updating step, and the evaluation index is an index determined based on the first plasticity coefficient and the second plasticity coefficient of the physical quantity.

* * * * *